US005845184A

United States Patent [19]

Nagahara et al.

[11] Patent Number: 5,845,184

[45] Date of Patent: Dec. 1, 1998

[54] DEVELOPING UNIT HAVING IMPROVED TONER DENSITY CONTROL

[75] Inventors: Akira Nagahara; Yoshio Yamaguchi; Shigenobu Utaka; Toshio Tooda; Haruyasu Watanabe; Sachio Sasaki; Mitsuhito Furukawa; Mitsuru Sato; Nobuo Kuwabara, all of Kawasaki; Takefumi Takahashi, Inagai, all of Japan

[73] Assignee: Fujitsu Limited, Kanagawa, Japan

[21] Appl. No.: 220,436

[22] Filed: Mar. 30, 1994

[30] Foreign Application Priority Data

Oct. 19, 1993 [JP] Japan ..... 5-284505

[51] Int. Cl.[6] ..... G03G 15/09

[52] U.S. Cl. ..... 399/277; 399/274; 430/106.6; 430/111

[58] Field of Search ..... 355/245, 246, 355/250, 251, 252, 253, 254, 269, 270, 296, 299; 118/652, 653, 657, 658; 430/106.6, 108, 125, 110, 122, 137, 111

[56] References Cited

U.S. PATENT DOCUMENTS

| | | | |
|---|---|---|---|
| 4,518,248 | 5/1985 | Nishikawa | 355/299 |
| 4,535,047 | 8/1985 | Colby, Jr. | 430/108 |
| 4,732,835 | 3/1988 | Katayama et al. | 430/106.6 |
| 4,751,164 | 6/1988 | Katayama et al. | 430/137 |
| 4,800,147 | 1/1989 | Savage | 118/652 X |
| 4,963,454 | 10/1990 | Yano et al. | 430/106.6 |
| 4,985,823 | 1/1991 | Tada et al. | 355/246 X |
| 5,188,057 | 2/1993 | Ishikawa et al. | 118/657 |
| 5,196,891 | 3/1993 | Shimazaki et al. | 355/269 |
| 5,396,317 | 3/1995 | Osawa et al. | 355/251 X |

FOREIGN PATENT DOCUMENTS

| | | |
|---|---|---|
| 0 060 703 A1 | 3/1982 | European Pat. Off. . |
| 0 430 038 A2 | 11/1990 | European Pat. Off. . |
| 0 430 038 A3 | 11/1990 | European Pat. Off. . |
| 0 418 823 A2/A3 | 3/1991 | European Pat. Off. . |
| 0 618 513 A2 | 10/1994 | European Pat. Off. . |
| 0 649 073 A2 | 4/1995 | European Pat. Off. . |
| 59-111662 | 6/1984 | Japan . |
| 59-216149 | 12/1984 | Japan . |
| 60-75854 | 4/1985 | Japan . |
| 60-003675 | 10/1985 | Japan . |
| 60-254171 | 12/1985 | Japan . |
| 01-090474 | 4/1989 | Japan . |
| 2-4281 | 1/1990 | Japan . |
| 3-252684 | 11/1991 | Japan . |
| 3-252686 | 11/1991 | Japan . |
| 4-159583 | 6/1992 | Japan . |

OTHER PUBLICATIONS

Goto et al.; "Developing Device"; Patent Abstracts of Japan; Publication No. 03–252686; Nov. 11, 1991; English Translation.

*Primary Examiner*—S. Lee

*Attorney, Agent, or Firm*—Armstrong, Westerman, Hattori, McLeland & Naughton

[57] ABSTRACT

A developing apparatus is provided for developing an electrostatic latent image on a latent image carrier by supplying the latent image carrier with a developer. This developing apparatus includes a toner accommodating chamber for accommodating magnetic toners. The apparatus also includes a developing roller, having a plurality of fixed magnetic pole members and sleeves provided along peripheries of the fixed magnetic pole members and rotating thereabout, for feeding the developer composed of magnetic carriers and magnetic toners to the latent image carrier. The apparatus further includes a developing chamber having a partition wall formed along the developing roller and assuming a configuration adapted to a shape of the developing roller, and a toner supply port for supplying the magnetic toners to the developing chamber from the toner accommodating chamber. In another mode of the developing apparatus, the center of each magnetic pole of the fixed magnetic pole members is located in a position deviating from the toner supply port. Further, in still another mode of the developing apparatus, there is employed the magnetic carrier the core of which is iron powder exhibiting strong saturation magnetization.

23 Claims, 23 Drawing Sheets

DEVELOPING UNIT HAVING IMPROVED TONER DENSITY CONTROL

BACKGROUND OF THE INVENTION

1. Field of the Invention

The present invention relates to a developing apparatus for performing a development by use of a developer composed of magnetic carriers and magnetic toners.

2. Description of the Related Art

An image forming apparatus such as a copying machine, a printer, a facsimile equipment, etc. utilizes a latent image forming type apparatus such as an electrophotographic apparatus from a demand relative to ordinary recording paper.

In such an image forming apparatus, after forming an electrostatic latent image on a photosensitive drum, the electrostatic latent image on this photosensitive drum is developed by a powdery developer and formed into a visible image. Further, after transferring the powdery developed image on the photosensitive drum onto a sheet, the sheet is separated, and the powdery developed image on the sheet is fixed thereto.

A known method for this development is a so-called 1.5-component developing method involving the use of the magnetic carriers and the magnetic toners. Based on this developing method, a toner density control mechanism is unnecessary, and the apparatus can be actualized with a simple construction. However, this developing method requires a contrivance for making an image quality uniform by controlling the toner density to a fixed level.

FIGS. 25A and 25B are views of assistance in explaining the prior art.

The above image forming apparatus will be explained by exemplifying, e.g., an electrophotographic printer apparatus. As illustrated in FIG. 25A, a precharger 91 charges the photosensitive drum 90 with an electricity. Thereafter, an image exposure is effected by an exposing unit 92, thereby forming an electrostatic latent image corresponding to an exposed image. A developing unit 93 is disposed for developing the electrostatic latent image on this photosensitive drum 90. This developing unit 93 feeds an internal powdery developer (e.g., a 1.5-component developer) to the photosensitive drum 90 and develops the electrostatic latent image on the photosensitive drum 90.

This developed image formed on the photosensitive drum 90 is transferred onto a sheet fed from an unillustrated sheet cassette by means of a transferring unit 94. Then, the image-transferred sheet is fed to a fixing unit 96, wherein the developed image on the sheet is fixed thereto. On the other hand, residual toners on the photosensitive drum 90 after the transfer are diffused over the photosensitive drum 90 by using a diffuse brush 95.

In this recording process, the transfer residual toners on the photosensitive drum 90 are diffused by the diffuse (uniforming) brush 95. Thereafter, a corona charger 91 performs uniform charging in a state where the toners are adhered onto the photosensitive drum 90. Subsequently, after the exposing unit 92 effects the image exposure, the developing unit 93 collects the transfer residual toners simultaneously with the development.

The 1.5-component developing unit 93 includes a developing chamber 931 and a toner supply chamber 930. Then, the toner supply chamber 930 accommodates only the magnetic toners which are supplied to the developing chamber 931 by use of an agitator. The developing chamber 931 constitutes a chamber having a fixed capacity with the aid of a partition wall 933. Then, a fixed amount of magnetic carriers are put into the developing chamber 931.

Accordingly, as illustrated in FIG. 25B, the toner supply chamber 930 replenishes the developing chamber 931 with the toners corresponding to a shortage via the toner supply port 935. The toner density in the developing chamber 831 thereby becomes uniform. This eliminates the necessity for a toner density control mechanism. The developer composed of the magnetic carriers and the magnetic toners in the developing chamber 931 forms a magnetic brush on a developing roller 932 incorporated into the developing chamber 931. Then, the developer on the developing roller 932 undergoes a restriction in terms of a layer thickness by means of a layer thickness restricting blade 934 and then fed to the photosensitive drum 90. The development is thus conducted.

In this type of conventional developing unit, as disclosed in Japanese Patent Laid-Open Publication NO.3-252684, the developing chamber 931 takes, as shown in FIG. 25B, a substantially angulate shape. Further, the magnetic pole of the developing roller 932 is located in a face-to-face relationship with the above toner supply port 935. Besides, the carrier involves the use of a ferrite carrier.

According to the prior art, as illustrated in FIG. 25B, the developing chamber 931 is shaped angulately, and, therefore, the magnetic carriers easily stagnate at the corners of the angulate chamber. The magnetic carriers are not contained in the developer moving on the developing roller 932, and it therefore follows that a toner density control value of the developer on the developing roller 932 deviates. Besides, a quantity of the magnetic carriers staying therein is not uniform, resulting in fluctuations in the toner density control value itself. This conduces to a decline of the developing quality.

Further, a height of bristles of the magnetic brush comes to its maximum at the center of the magnetic pole. According to the prior art, the magnetic pole is disposed in a position of the toner supply port 935, and hence the height of the bristles of the magnetic brush increases in the position of the toner supply port 935. For this reason, the magnetic carriers in the magnetic brush leak out of the toner supply port 935, with the result that the quantity of the magnetic carriers in the developing chamber 931 decreases. Therefore, this is the cause for fluctuating the toner density control value.

Similarly, the height of the bristles of the magnetic brush increases at the toner supply port 935, resulting in such a form that the toner supply port 935 is covered with the magnetic brush. This is an obstacle against supplying the toners. Hence, this also causes the fluctuations in the toner density control value.

Additionally, in this developing apparatus, a margin of the toner density control value advantageously augments with a smaller carrier particle size. In the prior art, however, the carriers involve the use of the ferrite carriers exhibiting a comparatively small magnetic force. Accordingly, when the carrier particle size is decreased, it follows that the carriers move onto the photosensitive drum 90 due to the developing action. A so-called carrier rise takes place. Therefore, the quantity of the magnetic carriers in the developing chamber 931 is reduced, which in turn causes the fluctuations in the toner density control value.

SUMMARY OF THE INVENTION

It is a primary object of the present invention to provide a developing apparatus capable of preventing fluctuations in a toner density control value.

It is another object of the present invention to provide a developing apparatus capable of preventing the fluctuations in the toner density control value by preventing a residence of carriers in a developing chamber.

It is till another object of the present invention to provide a developing apparatus capable of preventing the fluctuations in the toner density control value by preventing a reduction of the carriers in the developing chamber.

To accomplish the above objects, according to one mode of a developing apparatus of the present invention, there is provided a developing apparatus for developing an electrostatic latent image on a latent image carrier by supplying the latent image carrier with a developer, this apparatus comprising: a toner accommodating chamber for accommodating magnetic toners; a developing roller, having a plurality of fixed magnetic pole members and sleeves provided along peripheries of the fixed magnetic pole members and rotating thereabout, for feeding the developer composed of magnetic carriers and magnetic toners to the latent image carrier; a developing chamber having a partition wall formed along said developing roller and assuming a configuration adapted to a shape of said developing roller; and a toner supply port for supplying the magnetic toners to said developing chamber from the toner accommodating chamber.

According to this mode of the present invention, the developing chamber having the partition wall assuming the configuration adapted to the shape of the developing roller is provided. Consequently, this eliminates a location where the carriers stay in the developing chamber. The residence of the carriers in the developing chamber thereby disappears. Accordingly, all the carriers and toners are stirred in the developing chamber, thereby forming the magnetic brush. Hence, the toner density control value become fixed, thereby enhancing an image quality.

According to another mode of a developing apparatus of the present invention, there is provided a developing apparatus for developing an electrostatic latent image on a latent image carrier by supplying the latent image carrier with a developer, the apparatus comprising: a toner accommodating chamber for accommodating magnetic toners; a developing chamber supplied with the magnetic toners via a toner supply port from the toner supply accommodating chamber; a sleeve rotating for feeding the developer composed of magnetic carriers and the magnetic toners in the developing chamber to the latent image carrier; and a fixed magnetic pole member provided in the sleeve and having a plurality of magnetic poles, the center of each magnetic pole being located in a position deviating from the toner supply port.

According to another mode of the present invention, the center of the magnetic pole is located in the position deviating from the toner support port. It is therefore possible to prevent a leakage of the carriers into the toner support chamber because of an extension of the magnetic brush from the toner supply port. This in turn makes the toner density control value fixed, thereby enhancing the image quality.

According to still another mode of a developing apparatus of the present invention, there is provided a developing apparatus for developing an electrostatic latent image on a latent image carrier by supplying the latent image carrier with a developer, the apparatus comprising: a toner accommodating chamber for accommodating magnetic toners; developing rollers including rotatable sleeves provided along peripheries of a plurality of fixed magnetic pole members to feed the developer composed of the magnetic toners and the magnetic carriers the core of which is iron powder exhibiting strong saturation magnetization to the latent image carrier; a developing chamber provided with the developing rollers; and a toner support port for supplying the magnetic toners to the developing chamber from the toner accommodating chamber.

According to still another mode of the present invention, the magnetic carrier involves the use of the carrier the core of which is iron powder exhibiting the strong saturation magnetization. Therefore, a magnetic attracting force between the developing roller and the carrier increases. This makes a margin of the toner density large, and, hence, the carriers can be prevented from being attracted by the latent image carrier even when diminishing the carrier. Accordingly, a reduction of the carriers can be prevented. The toner density control value thereby becomes fixed, resulting in an enhancement of the image quality.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1A:
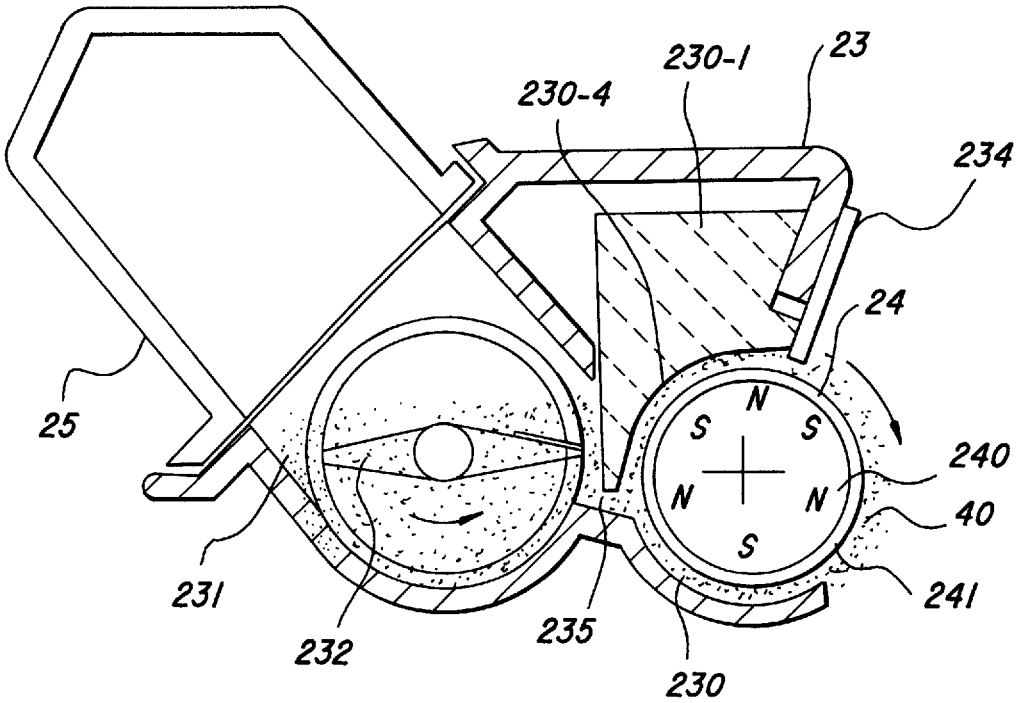
FIGS. 1A and 1B are views of assistance in explaining the principle of the present invention.
Figure 1B:
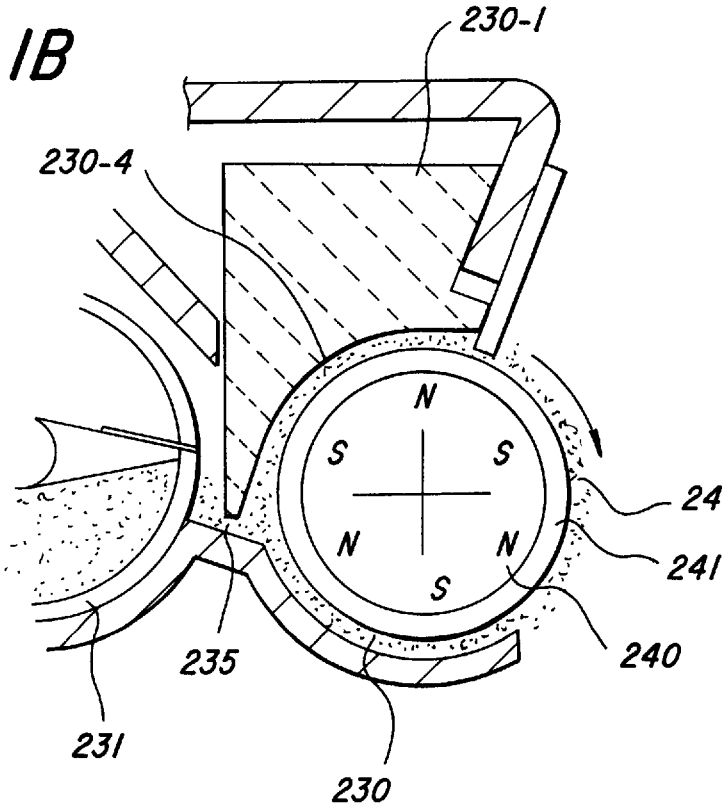

FIGS. 1A and 1B are views of assistance in explaining the principle of the present invention.

As illustrated in FIG. 1A, there is provided a developing chamber 230 having a partition wall 230-4 assuming a configuration adapted to a shape of a developing roller 24. This arrangement eliminates a residence of carriers in the developing chamber 230. This further results in no possibility where the carriers stay in the developing chamber 230. Accordingly, all the carriers and toners are stirred in the developing camber 230, thereby forming a magnetic brush. A toner density control value thereby becomes fixed. With this processing, an image quality is enhanced.

Further, as depicted in FIG. 1B, the center of a magnetic pole N of a fixed magnetic pole member 240 is located in a position deviating from a toner supply port 235. It is therefore possible to prevent a leakage of the carriers into the toner supply port 231 because of an extension of the magnetic brush from the toner supply port 235. This also makes the toner density control value fixed, thereby enhancing the image quality.

Moreover, the magnetic carrier in the developing chamber 230 involves the use of a carrier the core of which is iron powder exhibiting strong saturation magnetization. Hence, a magnetic attracting force between the developing roller 24 and the carriers increases. This in turn makes a margin of the toner density large. It is therefore feasible to prevent the carriers from being attracted by a latent image carrier even when diminishing the carrier. Accordingly, a reduction of the carriers can be prevented. With this arrangement, the toner density control value becomes fixed, thereby enhancing the image quality.

Figure 2:
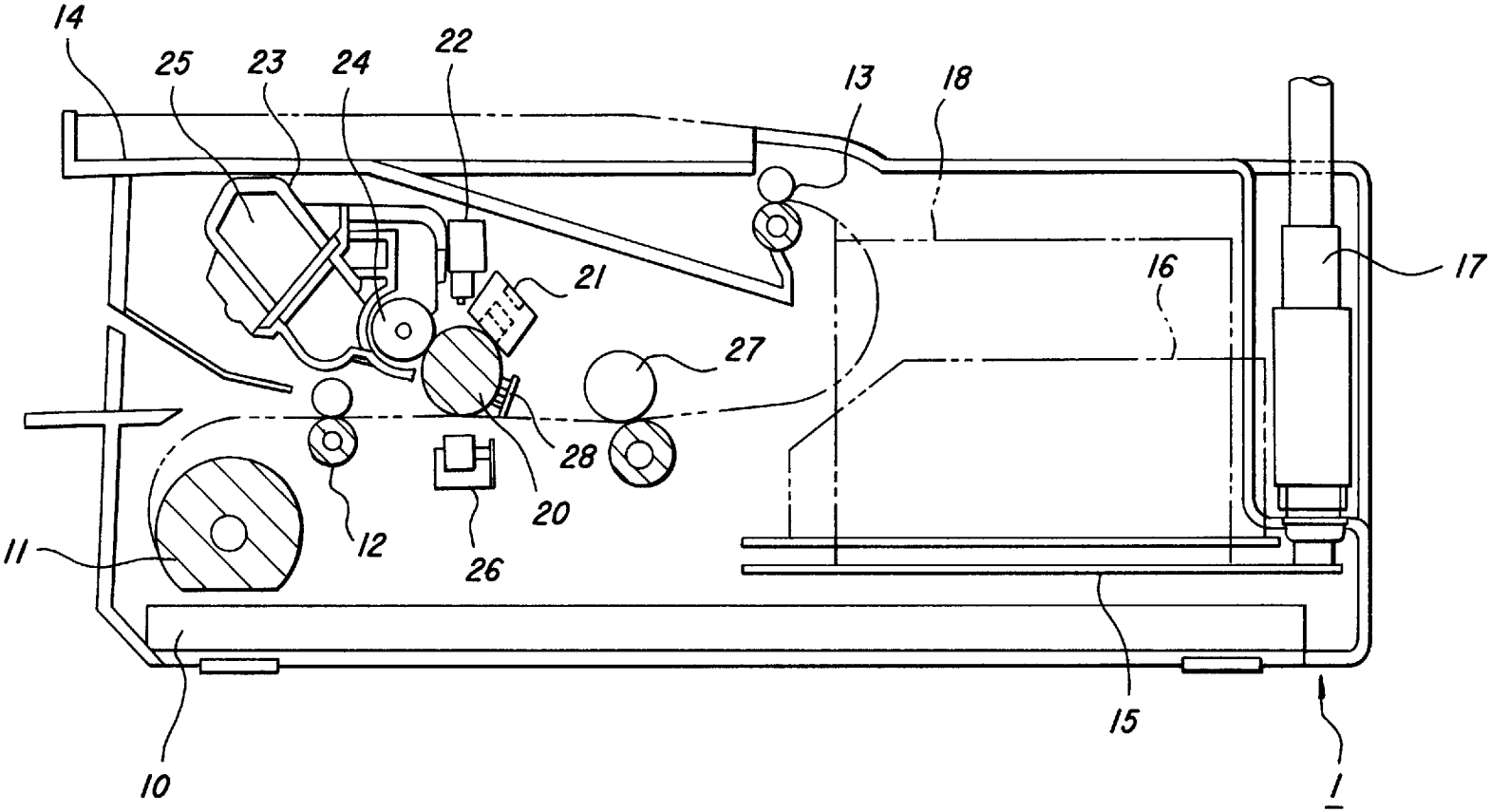
FIG. 2 is a view showing a construction of embodiment of the present invention.
Figure 3:
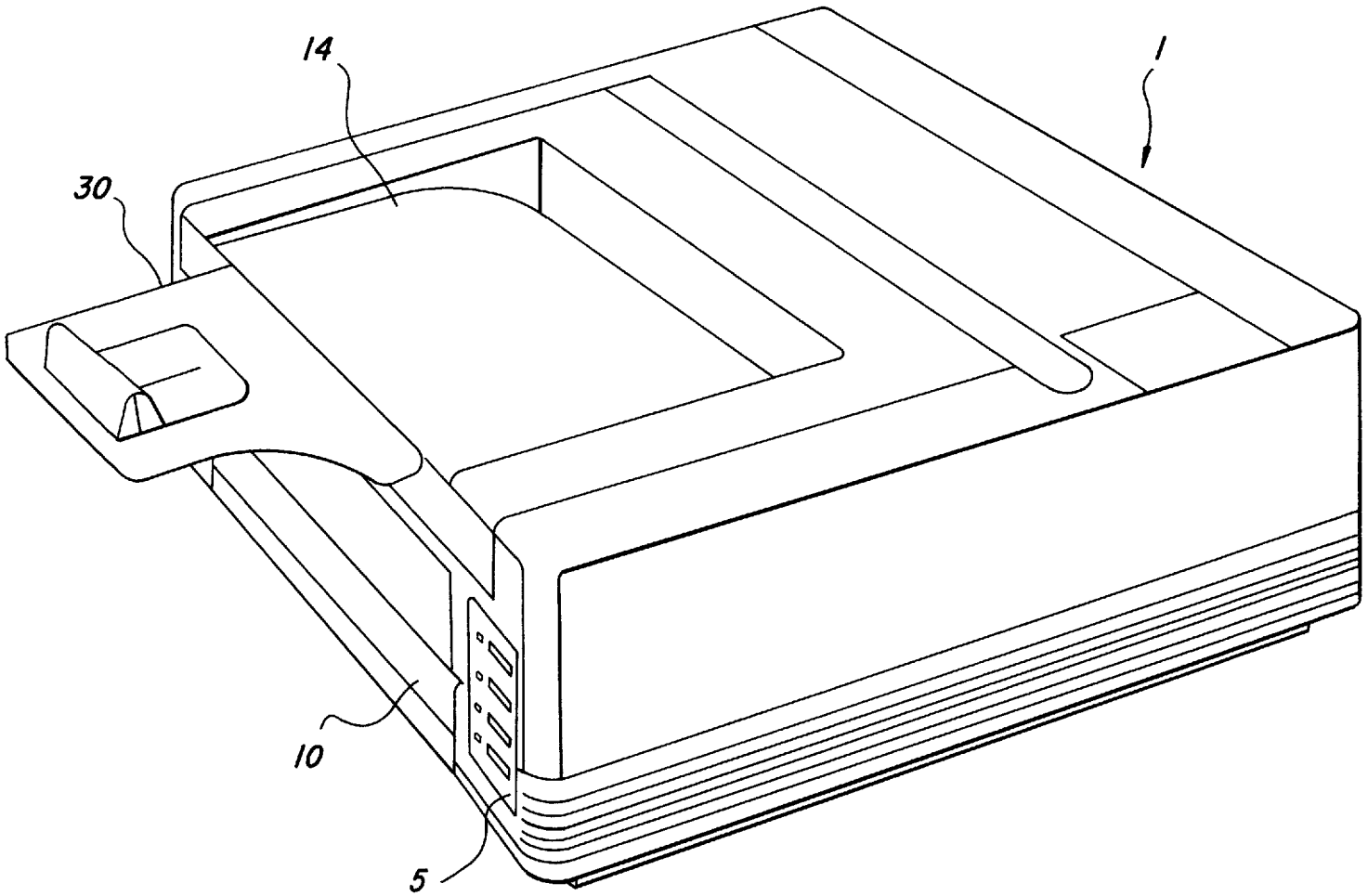
FIG. 3 is a view illustrating a state where an apparatus of FIG. 2 is installed horizontally.
Figure 4:
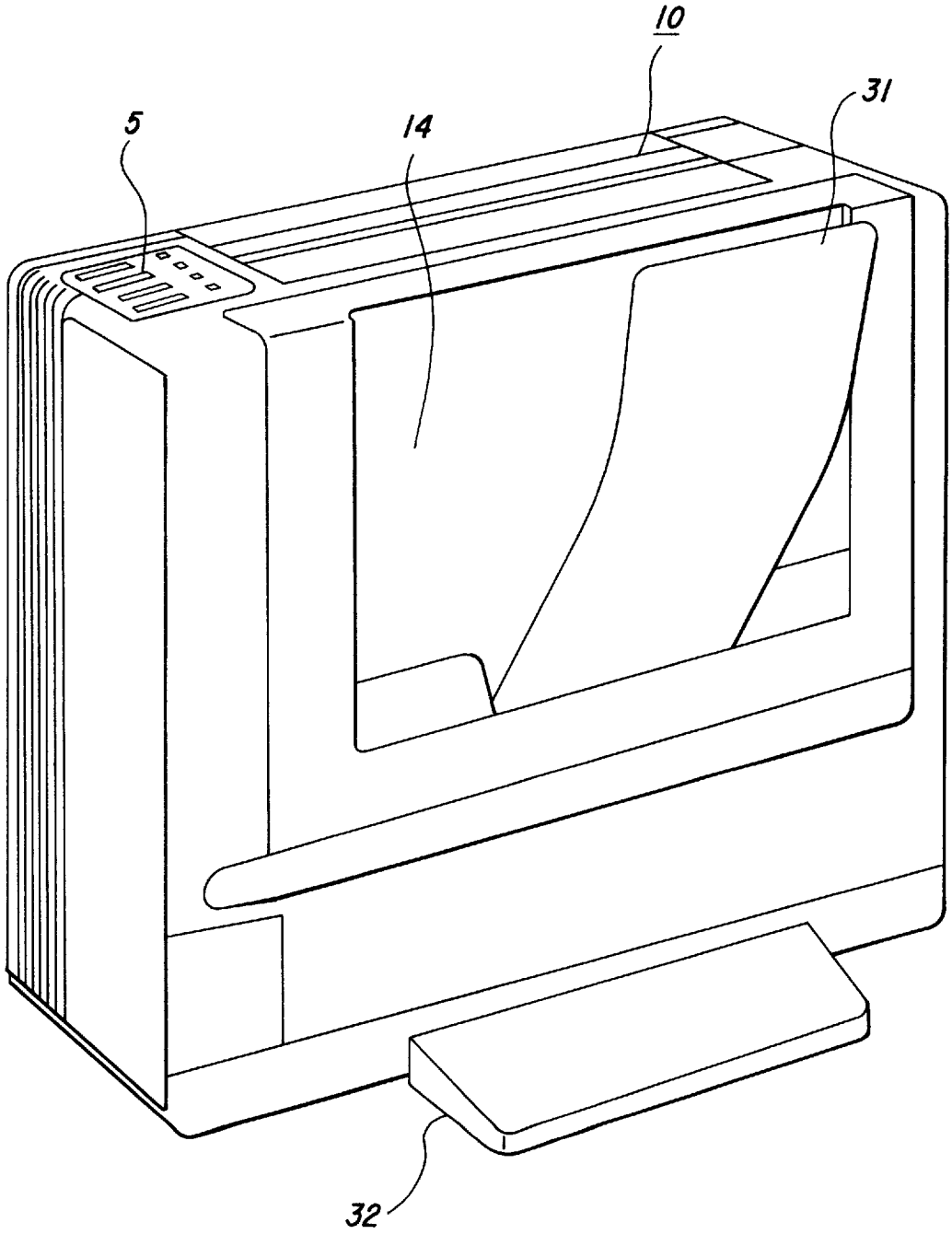
FIG. 4 is a view illustrating a state where the apparatus of FIG. 2 is installed upright.

FIG. 2 is a view illustrating a construction of a printer apparatus according to one embodiment of the present invention. FIG. 3 is a view illustrating a state where the apparatus of FIG. 2 is horizontally installed. FIG. 4 is a view illustrating a state where the apparatus of FIG. 2 is vertically installed. The Figures shows a cleanerless electrophotographic printer.

Referring to FIG. 2, a photosensitive drum 20 is an aluminum drum on which a functionally separate organic photosensitive body is coated about 26 microns thick. This photosensitive drum 20 has an outside diameter on the order of 24 mm and rotates counterclockwise at a peripheral speed of 25 mm/s. A precharger 21 is defined as a non-contact type charger constructed of a Scolotron. This precharger 21 uniformly electrifies the surface of the photosensitive drum 20, i.e., charges the surface of the photosensitive drum 20 with −650V.

An optical unit 22 image-exposes the uniformly electrified photosensitive drum 20, thus forming an electrostatic latent image. This optical unit 22 involves the use of an LED optical system attained by combining an LED array with a self-focus lens . This optical unit 22 image-exposes the photosensitive drum 20 in accordance with an image pattern, thereby forming an electrostatic latent image on the order of 31 50 to −100V on the photosensitive drum 20.

A developing unit 23 supplies the electrostatic latent image on the photosensitive drum 20 with a developer composed of magnetic carriers and magnetic toners, thus making the image visible. This developing unit 23 will hereinafter be discussed with reference to Figures after FIG. 5 inclusive. Developing rollers 24 feed the developer to the photosensitive drum 20. A toner cartridge 25 filled with the magnetic toners is so fitted to the developing unit 23 as to be replaceable. This toner cartridge 25 is replaced when in empty of the toners and replenishes the developing unit 23 with the magnetic toners.

A transfer unit 26 is constructed of a corona discharger. This transfer unit 26 electrostatically transfers the toner image on the photosensitive drum 20 onto a sheet. An operational principle thereof is that a voltage on the order of +5 to +10 kV is applied to a corona wire from a power supply, thereby generating electric charges through corona discharging. The back of sheet is charged with these electric charges, and the toner image on the photosensitive drum 20 is thereby transferred onto the sheet. It is desirable that this power supply be a constant current power supply capable of reducing a drop of a transfer efficiency depending on the environment by supplying the sheet with a fixed amount of electric charges.

A fixing unit 27 thermally fixes the toner image on the sheet. The fixing unit 27 comprises a heat roller incorporating a halogen lamp as a heat source and a pressurizing roller (backup roller). Then, the sheet is heated up, thereby fixing the toner image onto the sheet.

A diffuse (uniforming) member 28 is constructed of a conductive member. This diffuse member 28 contacts the photosensitive drum 20 to diffuse the toners remaining concentratedly on the photosensitive drum 20 for facilitating a collection in the developing unit 23.

A sheet cassette 10 accommodates the sheets and is detachably attached to the apparatus. This sheet cassette 10 provided in a lower portion of the apparatus is attachable to and detachable from the front surface of the apparatus, i.e., from the left side in FIG. 2. Pickup rollers 11 pick up the sheet in the sheet cassette 10. Resist rollers 12 align the leading edge of the sheet when the sheet impinges thereon. The sheet is thus fed to transferring unit 26. Sheet eject rollers 13 eject the image-fixed sheet into a stacker 14. The stacker 14 mounted on the upper surface of the apparatus stacks the ejected sheets.

A printed circuit board 15 is mounted with a control circuit of the apparatus. A power supply 16 supplies respective elements of the apparatus with the electric power. An I/F connector 17 connected to an outside cable is inserted into the apparatus. The I/F connector 17 is connected to a connector of the printed circuit board 15. An option board 18 is mounted with a different type of emulator circuit, a font memory, etc.

The operation of this embodiment will be explained. The Scolotron charger 21 uniformly charges the surface of the photosensitive drum 20 with −650V, and, thereafter, the image exposure is effected by the LED optical system 22. With this processing, the photosensitive drum 20 is formed with an electrostatic latent image with a background area on the order of −650V and a print area on the order of 50 to −100 V.

A developing bias voltage (−300V) is applied to a sleeve of the developing rollers 24 of the developing unit 23. Therefore, this electrostatic latent image is developed with magnetic polymerization toners minus-electrified beforehand by stirring with the magnetic carriers in the developing unit 23. The electrostatic latent image thus turns out a toner image.

On the other hand, the sheet is picked by the pick rollers 11 out of the sheet cassette 10. The leading edge of the sheet is aligned by the resist rollers 12, and the sheet is then fed toward the transferring unit 26. Subsequently, the toner image on the photosensitive drum 20 is transferred onto the sheet by dint of the electrostatic force. This sheet toner image is fixed onto the sheet by the fixing unit 27. The sheet passes via an U-shaped feeding path and is ejected into the stacker 14 by means of the sheet eject rollers 13.

The residual toners on the photosensitive drum 20 after the transfer are diffused by the diffuse member 28, and, besides, the residual electric charges are eliminated. Then, the residual toners on the photosensitive drum 20 pass through the LED optical system as well as through the Scolotron charger 21 and reach the developing unit 23. The residual toners are collected simultaneously with a next developing process. The collected toners are reused in the developing unit 23.

The cleanerless process is used in this embodiment. That is, the transfer efficiency of the developer onto the sheet is not 100%, and, therefore, some toners (developer) are left on the photosensitive drum. For this reason, it is required that the residual toners be eliminated. It is not, however, preferable to provide a cleaner for eliminating the residual toners. Namely, a method of eliminating the residual toners by the cleaner requires a mechanism for reserving the eliminated toners, resulting in a scale-up of the apparatus. Further, the eliminated toners do not contribute to printing, and hence this is not profitable. Moreover, a disposal of the toners may come into an issue in terms of the environment.

In this cleanerless process, the diffuse brush 28 diffuses the toners concentrated on one area. With this diffusion, a toner quantity per unit area is reduced to facilitate the collection by the developing unit 23. Exhibited further is such an advantage that a filter effect of a shower of ions in the corona charger 21 is restrained, and the charged electric potential is uniformed. An additional advantage is that the filter effect of the exposure in the image exposing process is restrained, the image is properly exposed on the photosensitive drum 20.

A point of this recording process is that the toners on the photosensitive drum 20 are collected simultaneously with the developing process. Given below is an explanation where the photosensitive drum 20 is minus-electrified, and the toners are also minus-electrified. A surface potential of the photosensitive drum 20 is set to 31 500 through −1000 V by the charger 21. The exposed area with a drop of the electric potential due to the image exposure on the photosensitive drum 20 decreases down to 0 through—several 10 V in its electric potential. An electrostatic latent image is thus formed. On the other hand, when developed, a substantially intermediate developing bias voltage (e.g., −300 V) between the surface potential and the latent image potential is applied to the developing rollers 24.

In the developing process, the minus-electrified toners adhered onto the developing rollers 24 adhere to the electrostatic latent image on the photosensitive drum 20 by an electric field formed by the developing bias voltage and the latent image potential. A toner image is thus formed. In the cleanerless process, simultaneously with this developing process, the transfer residual toners diffused on the photosensitive drum 20 in the uniforming process by the diffuse brush 28 are collected by the developing rollers from on the photosensitive drum 20 by dint of the electric field formed by the surface potential and the developing bias voltage.

Further, according to 1.5 component developing method, the magnetic brush contacts the photosensitive drum 20. Hence, a mechanical adhesion of the residual toners is decreased by a mechanical sweeping force of the magnetic brush. Besides, there is generated a magnetic attracting force of the residual toners (magnetic toners) and the carriers of the magnetic brush. The collection of the residual toners is thereby facilitated.

High down-sizing of this apparatus can be attained for the reason of having no cleaner and so on. The apparatus shown in FIG. 2 is 350 mm long, 345 mm wide and 130 mm high, including the sheet cassette 10. Accordingly, the apparatus as a printer for a personal use is readily installed on the disk.

Further, as illustrated in FIG. 3, the apparatus can be horizontally placed with the sheet cassette 10 being horizontal to the installation surface. Referring to FIG. 3, an operation panel 5 is provided on the front surface of the apparatus and is intended to indicate an operation of the apparatus. Further, a sheet guide 30 is provided at the front edge of the stacker 14. This sheet guide 30 has a function to hold the edge of the sheet ejected into the stacker 14 and align the edge thereof.

In accordance with this embodiment, the sheet cassette 10 is attached to and detached from the front surface of the apparatus, and the operation panel 5 is also operable. Further, the eject sheets are also ejected from the front surface of the apparatus.

Moreover, as illustrated in FIG. 4, the I/F connector 17 of the apparatus of FIG. 2 is provided on the installation surface. The image can be also formed in state where the sheet cassette 10 is so installed upright as to be perpendicular to the installation surface. With this arrangement, the installation area can be made smaller than before. At this time, the stacker 14 is provided with a sheet holder 31 for holding the sheet to prevent a fall-down of the sheet to be ejected into the stacker 14. Even when installed upright, the fall-down of the sheet can be prevented. Further, a stand 32 is provided on the installation surface of the apparatus, whereby the apparatus can be stably installed even when installed upright.

Moreover, even with an elimination of the cleanerless process, the precharger 1 and the transferring unit 26 are constructed of a non-contact type discharger. Therefore, the toners on the photosensitive drum 20 are not adhered to these units, with the result that the uniform electrification and the transfer are stably executable.

Figure 5:
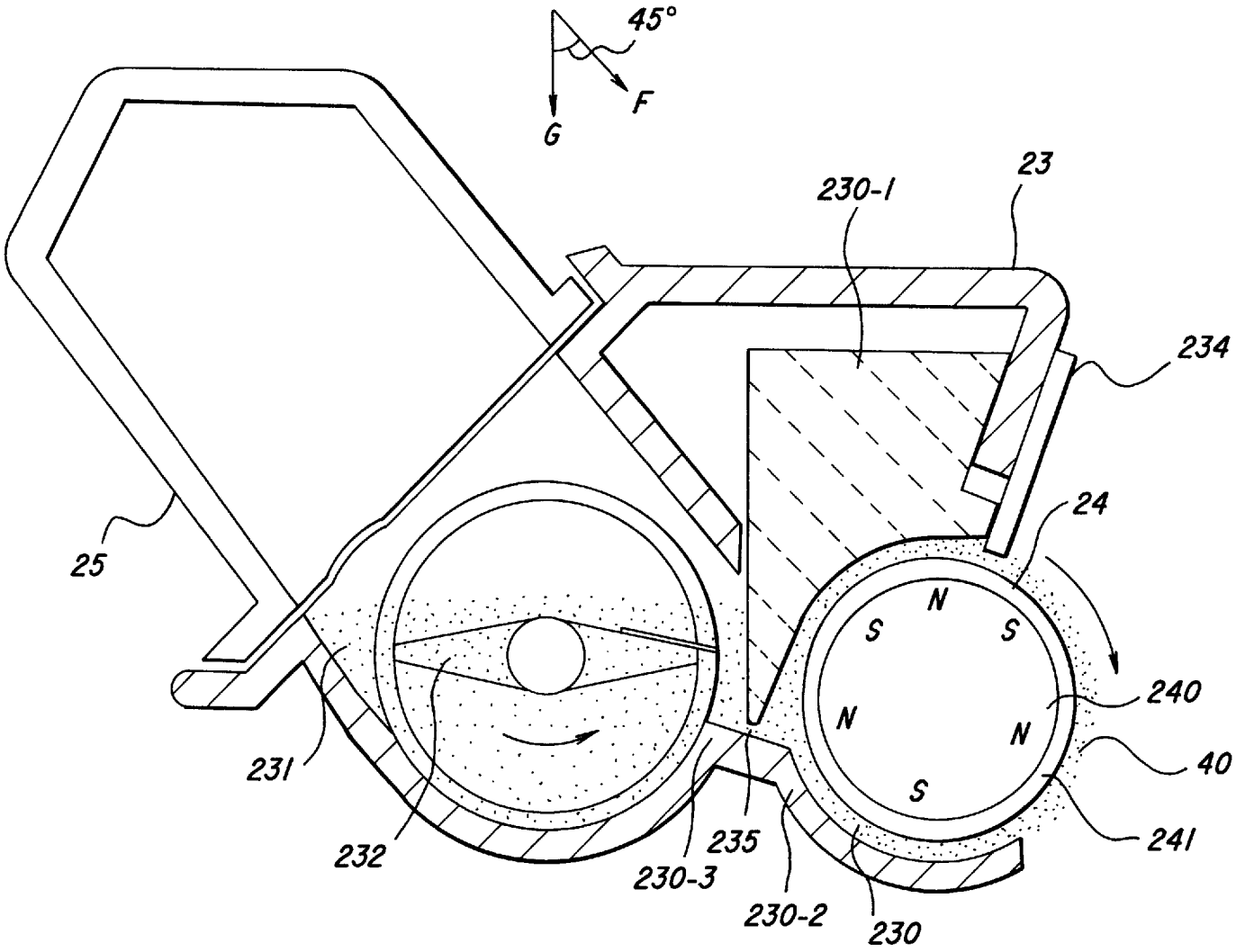
FIG. 5 is a view showing a configuration of a developing unit of FIG. 2.
Figure 6:
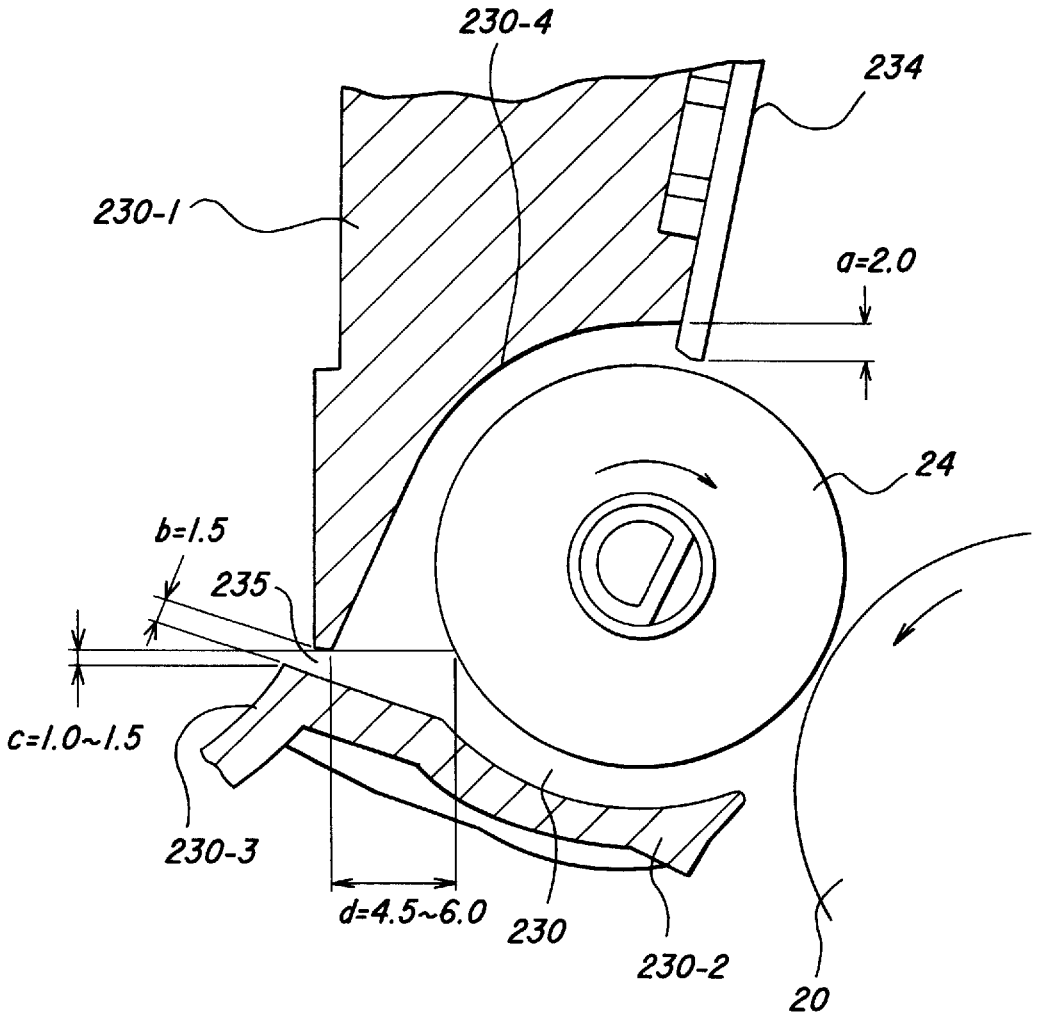
FIG. 6 is a sectional view showing the principal elements of the developing unit of FIG. 5.
Figure 7:
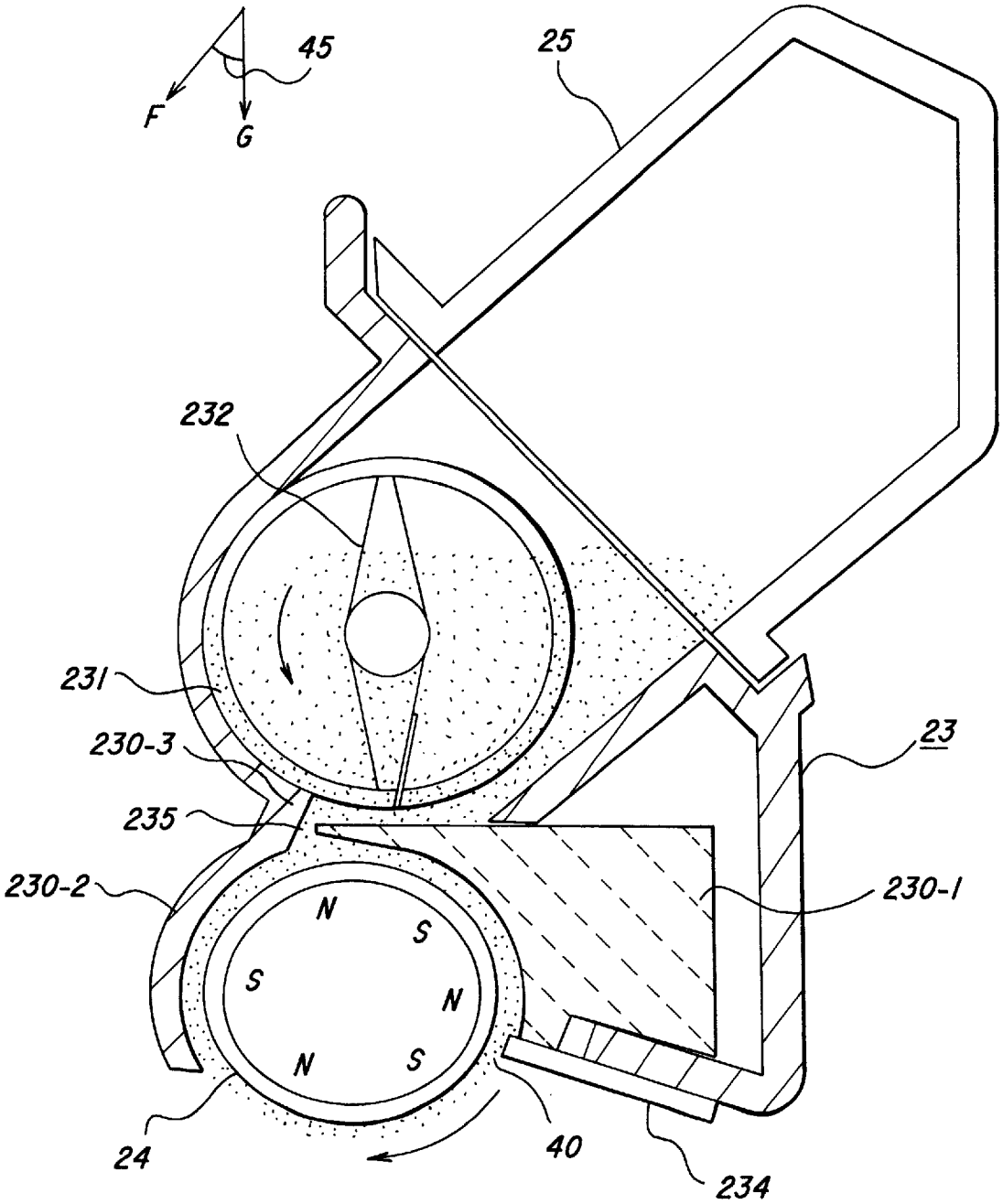
FIG. 7 is a view showing a state where the developing unit of FIG. 5 is installed upright.
Figure 8A:
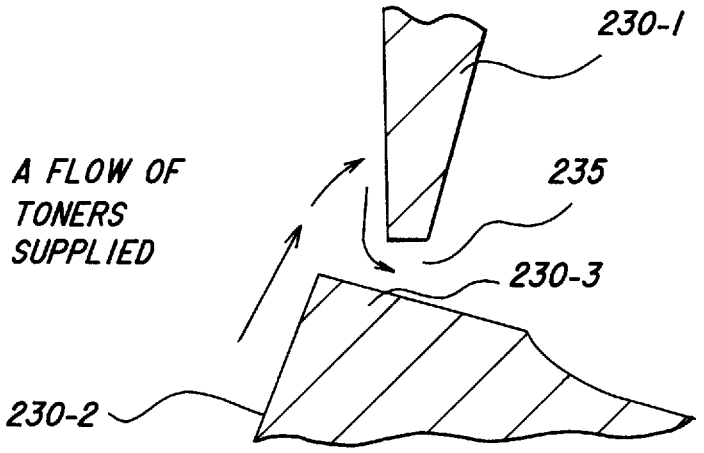
FIGS. 8A and 8B are views of assistance in explaining how the developing unit of this invention operates.
Figure 8B:
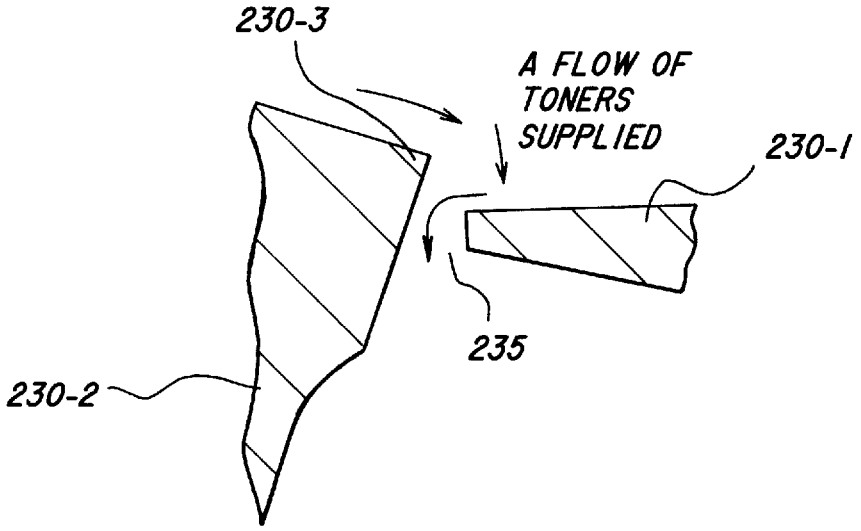
Figure 9:
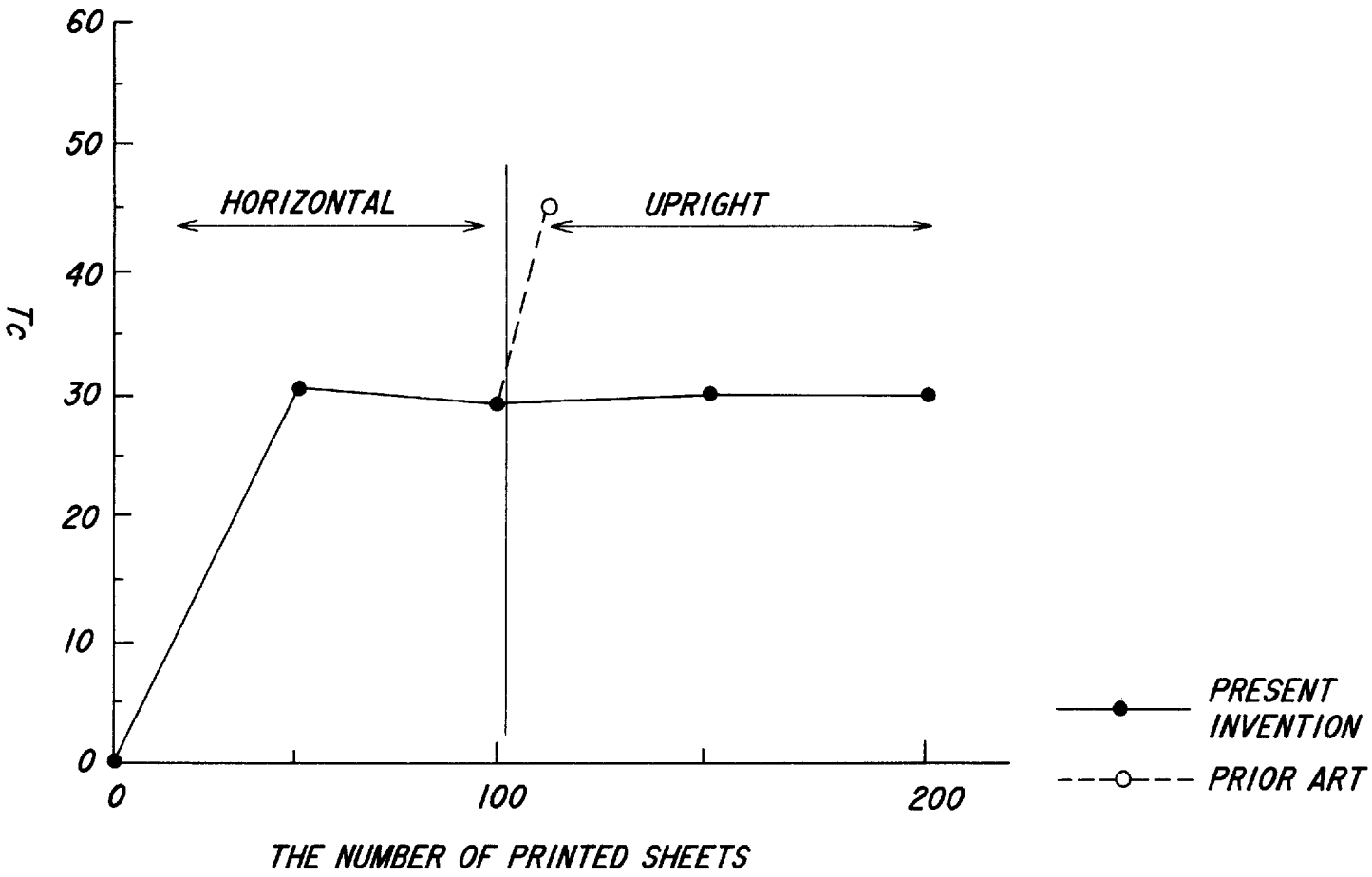
FIG. 9 is a characteristic diagram showing an operation of forming an image according to this invention.

FIG. 5 is a view illustrating a configuration of the developing unit of FIG. 2. FIG. 6 is a sectional view showing the principal elements of the developing unit of FIG. 5. FIG. 7 is a view showing a state where the developing unit of FIG. 2 is installed upright. FIGS. 8A and 8B are views of assistance in explaining the operation of how the toners are supplied. FIG. 9 is a characteristic diagram of the image forming operation according to this invention.

Turning to FIG. 5, the developing rollers 24 are magnetic rollers constructed of a metal sleeve 241 and a magnet 240 incorporated therein and having a plurality of magnetic poles. The developing rollers 24 feed a magnetic developer which will be mentioned later with the aid of rotations of the sleeve, while the magnet 240 inside the sleeve 241 is fixed. The developing roller 24 is 16 mm in diameter and rotates three times (75 mm/s) as high as the peripheral speed of the photosensitive drum 20.

A developing chamber 230 is formed along the periphery of the developing roller 24. An interior of the developing chamber 230 is filled with a 1.5-component developer conceived as a mixture of the magnetic carriers and the magnetic toners. This developing chamber 230 is defined by an upper partition member 230-1 and a lower bottom 230-2 and has a fixed capacity.

Accordingly, when a fixed quantity of magnetic carried are charged into the developing chamber 230, a quantity of the magnetic toners in this developing chamber 230 becomes fixed. A quantity of the developer of this developing chamber 230 is fixed, and, therefore, when the magnetic toners for a consumption are replenished from a toner hopper 231, a toner density becomes uniform. A necessity for controlling the toner density is thereby eliminated. That is, the developing chamber 230 is charged with the carriers of a quantity corresponding to a control point of the toner density, thereby automatically controlling the toner density in a predetermined range.

Further, this developing chamber 230 is always filled with the developer along the developing roller 24. Accordingly, even if the apparatus is installed upright, it is possible to avoid a situation where the developer in the developing chamber 230 concentrates on one side enough not to supply the developing roller 24 with the developer.

A developer 40 involves the use of a magnetite carrier as a magnetic carrier which has an average particle size on the order of 40 microns and further a magnetic toner having an average particle size of 7 microns and manufactured by the polymerization method. The polymerized toners are uniform of the particle size but sharp of a particle size distribution. Hence, in the transfer process, the toner image on the photosensitive drum 20 uniformly adheres to the sheet. For this reason, the electric field in the transfer area becomes uniform. The transfer efficiency can be more enhanced than by the toners based on the conventional pulverizing method. The transfer efficiency of 60–90% in the pulverized toners is improved to 90% or above in the polymerization toners.

The toner density of these toners is, though 5–60 wt % is proper, set to 25 wt % in this embodiment.

A doctor blade 234 serves to regulate a quantity of the developer supplied by the developing rollers 24 to the photosensitive drum 20 so as not to cause an oversupply or reversely an undersupply to the electrostatic latent image on the photosensitive drum 20. The regulation thereof is performed in a gap between an edge of the doctor blade 234 and the surface of the developing roller 24. Normally, the gap is adjusted to approximately 0.1–1.0 mm.

The toner hopper 231 is filled with only the magnetic toners and includes a supply roller 232 inside. The toners are supplied to the developing chamber 230 with rotations of this supply roller 232.

The toners supplied into this developing chamber 230 are stirred in the developing chamber 230 and rubbed against the carriers by a developer feeding force and a magnetic force of the developing roller 24 and a developer restricting function of the doctor blade 234. The toners are thereby electrified to a predetermined polarity and with an electrifying quantity. In accordance with this embodiment, an electrifying system of the carriers and the toners is adjusted so that the toners are minus-electrified.

Further, the gap between the partition member 230-1 and the developing roller 24 is made smaller than a bristle height of the magnetic brush formed on the developing roller on the upstream side of the blade 234. Herein, as shown in FIG. 6, a gap a is set to 2.0 mm. With this setting, the magnetic brush on the developing roller 24 undergoes a regulation by the partition member 230-1 and then receives a force with rotations of the developing roller 24. For this reason, a stirring property of the developer in the developing chamber 230 enhances, thereby making it possible to obtain a stable toner electrifying quantity even in a range of the high toner density.

Further, a wall surface 230-4 of this partition member 230-1 is formed in a shape along the developing roller 24. Namely, the wall surface 230-4 assumes basically a circular arc at the gap a. Hence, there exists no place where the magnetic carriers stay. Consequently, all the magnetic carriers and magnetic toners are always stirred along the developing rollers 24 and then fed. Accordingly, fluctuations in toner density control value can be prevented.

Moreover, all the magnetic carries and magnetic toners are stirred, and, therefore, the stable toner electrifying quantity can be expected even in the range of high toner density. Besides, even when installed horizontally or upright, the electrifying effect does not change.

Provided between the toner hopper 231 and the developing chamber 230 is a toner supply passage 235 defined by the distal end of the partition member 230-1 and the bottom 230-2. A width b of this toner supply passage 235 is, as shown in FIG. 6, 1.5 mm. The toners of the toner hopper 231 are supplied via this toner passage 235 to the developing chamber 230.

The bottom 230-2 forming this developing chamber 230 includes a projection 230-3 protruding from the toner hopper 231. Furthermore, this bottom 230-2 shapes an oblique surface extending upward from the photosensitive drum 20. A gap c between the distal end of this projection 230-3 and the distal end of the partition member 230-1 is set, as illustrated in FIG. 6, to 1.0–1.5 mm. That is, the bottom 230-2 is inclined by a quantity corresponding thereto.

Additionally, a gap d between the partition member 230-1 and the wall surface 230-4 is set to 4.5–6.0 mm. In this way, the gap d in the position of the toner supply passage 235 is set larger than the gap a in other position. It is therefore possible to prevent the tip of the magnetic brush from extending into the toner supply passage 235. For this reason, it is feasible to prevent the magnetic carrier in the developing chamber 230 from leaking into the toner supply chamber 231 from the toner supply passage 235. Hence, a reduction in quantity of the magnetic carriers in the developing chamber 230 can be prevented. The toner density control value can be therefore kept to a fixed value. At the same time, the magnetic brush does not become an obstacle against the operation to supply the toners via the toner supply passage 235.

An angle made by two wall surfaces f the toner cartridge 25 and the toner hopper 231 is set at approximately 45 degrees to the direction of gravity. A flowing direction of the toners is set at 45 degrees. With this setting, as will be stated later, even when the apparatus is installed upright, the toners can be smoothly supplied.

Next, the operation of this developing unit will be explained. FIG. 5 illustrates a state of the developing unit when the apparatus shown in FIG. 3 is installed horizontally. The angle made by the wall surfaces of the toner cartridge 25 and the toner hopper 231 is set at about 45 degrees to the direction of gravity. For this reason, the toners flows toward the bottom of the toner hopper 231 and are smoothly supplied to the supply rollers 232.

In this horizontal installation, the toners exhibits a fluidity toward the bottom in the toner hopper 231 because of the gravity. The supply rollers scrape up the toners in the bottom of the toner hopper 231. At this time, as illustrated in FIG. 8A, the toners raised by the supply rollers 232 temporarily impinge on the partition member 230-1 via the projection 230-3 of the bottom 230-2 and enter the toner supply passage 235.

Consequently, only the toners for a supply by the toner supply rollers 232 enter the toner supply passage 235. Simultaneously, the relevant portion of the partition member 230-1 serves as a buffer. An intruding force by the toner supply rollers 232 does not exert an influence directly on the toner supply passage 235. Hence, an excessive intrusion of the toners can be prevented, and the developing chamber 230 is replenished with the toners of a quantity for a shortage.

In this case, the bottom 230-2 is tilted upward with respect to the rotating direction of the developing roller 24. Therefore, the magnetic brush of the developing roller 24 after passing through the photosensitive drum 20 and the carriers off the brush do not leak into the toner supply chamber 231 from the toner supply passage via the bottom 230-2. It is therefore feasible to prevent a reduction in the starter carriers of the developing chamber 230, and the stable 1.5-component phenomenon is attainable.

On the other hand, in the state of the developing unit where the apparatus shown in FIG. 7 is installed upright as in FIG. 4, the angles made by the wall surfaces of the toner cartridge 25 and the toner hopper 231 is set at 45 degrees to the direction of gravity. Hence, even when installed upright, the toners can be smoothly supplied to the supply rollers 231.

This angle made by the wall surfaces of the toner cartridge 25 and the toner hopper 231 is, it is proper, set on the order of 45 degrees ±10 degrees to the direction of gravity in consideration of an angle of repose in order to feed the toners well by the dead weight. A good result will be obtained when set at preferably 45 degrees ±5 degrees.

At this time, as illustrated in FIG. 7, the toners stay in the toner hopper 231 of the partition member 230-1 and easy to drop down into the developing chamber 230 from the toner supply passage 235. As shown in FIG. 8B, however, the projection 230-3 of the bottom 230-2 restricts the drop-down of the toners from the toner supply passage 235. Consequently, there is almost no falling of the toners. Hence, the supply of the toners depends on the rotating force of the toner supply rollers 232.

That is, as depicted in FIG. 8B, the toners pushed by the supply rollers 232 temporarily impinge on the partition member 230-1 through the projection 230-3 of the bottom 230-2 and thus enter the toner supply passage 235. Only the toners for a supply by the toner supply rollers 232 are thereby come into the toner supply passage 235. With this action, the relevant portion of the partition member 230-1 serves as a buffer, and the intruding force by the toner supply roller 232 does not directly become a force for supplying the toners. It is therefore possible to prevent an excessive intrusion of the toners. The developing chamber 230 is replenished with the toners of a quantity for a shortage.

This implies that the capability of supplying the toners to the developing chamber 230 does not change even when the apparatus is installed horizontally or upright. For this reason, even when the apparatus is installed horizontally or upright, the toner density in the developing chamber 230 does not vary, whereby variations in the image density can be prevented.

Further, the upright installation may cause the dropdown of the developer from the developing unit 23. However, the magnetic two-component developer is employed as the developer, and hence the developer is stuck to the developing rollers 24 by the magnetic force. Consequently, even when installed upright, almost no falling of the developer takes place.

Particularly when using the magnetic carriers and the magnetic toners, both of the carriers and the toners are held by the magnet rollers of the developing rollers 24. Therefore, the falling of the developer can be prevented all the more. Even if such an upright installation is done, the stable development can be attained.

FIG. 9 is a characteristic diagram showing variations in the toner density Tc in the case of performing the print when the apparatus is installed upright after the print has been effected with the apparatus installed horizontally.

To start with, the apparatus is installed horizontally, and a predetermined amount of start carriers are put into the developing chamber 230 of the developing unit 23. The developing unit is then operated, and the printing process is thus conducted. As a result, the toners are gradually supplied from the developing chamber 230. Hence, the toner density enhances with an increase in the number of printed sheets. Then, just when the developing chamber is full of the carriers and the toners, the toner density is 30 wt %. Thereafter, even when the number of the printed sheets increases, no change in the toner density can be seen.

Next, in this state, the apparatus is changed to the upright installation, and the printing process is thus performed. As a result, the toner density remains the same with the horizontal installation. According to the conventional configuration disclosed in Japanese Patent Laid-Open Publication No. 3-252686, as shown by the white circle in the Figure, when installed upright, the toner density enhances. There is some difference in the toner density between the horizontal installation and the upright installation. The image density therefore changes. This implies the stable action of the above-mentioned toner supply. With this action, the image can be formed with no change in the image density even when the apparatus is installed horizontally or upright. It is possible to actualize the image forming apparatus capable of being installed horizontally and upright as well.

Figure 10:
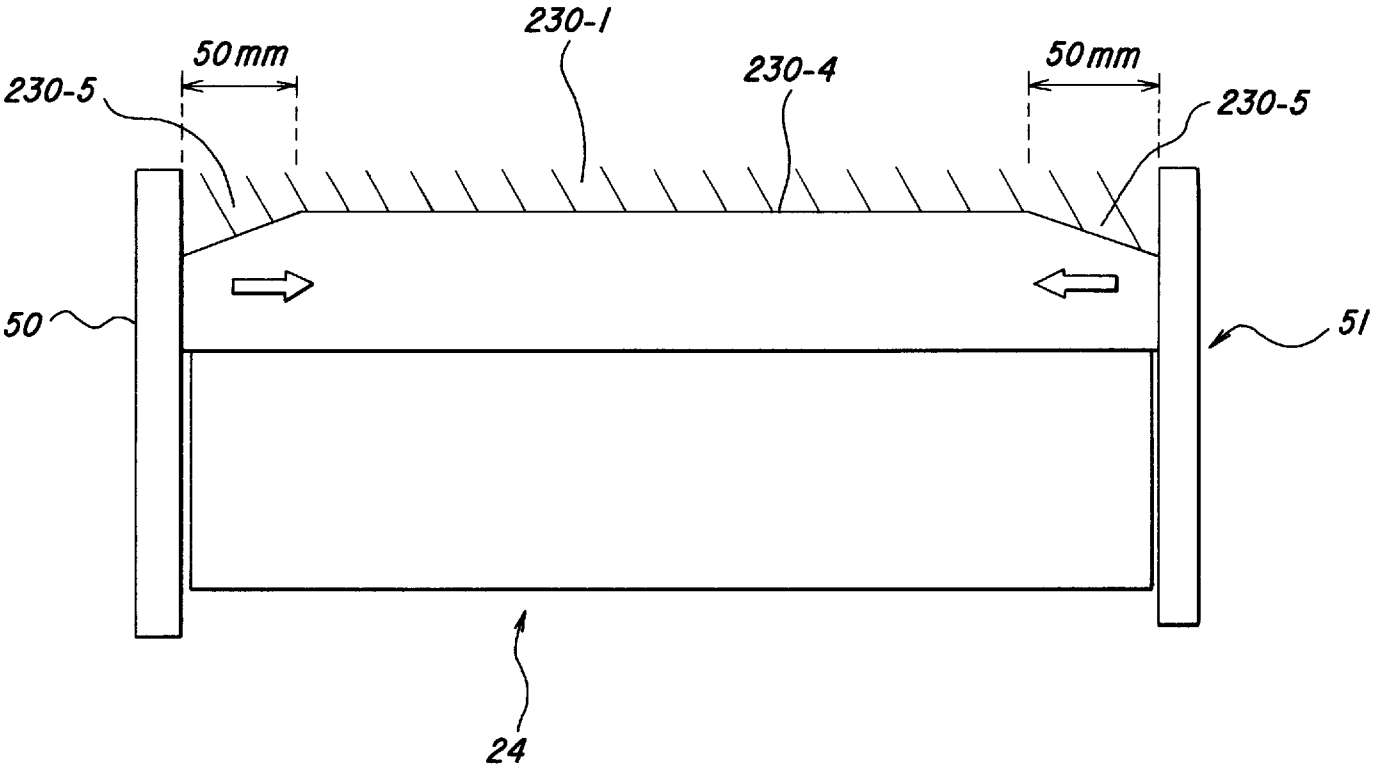
FIG. 10 is a front elevation of the developing unit of FIG. 5.
Figure 11:
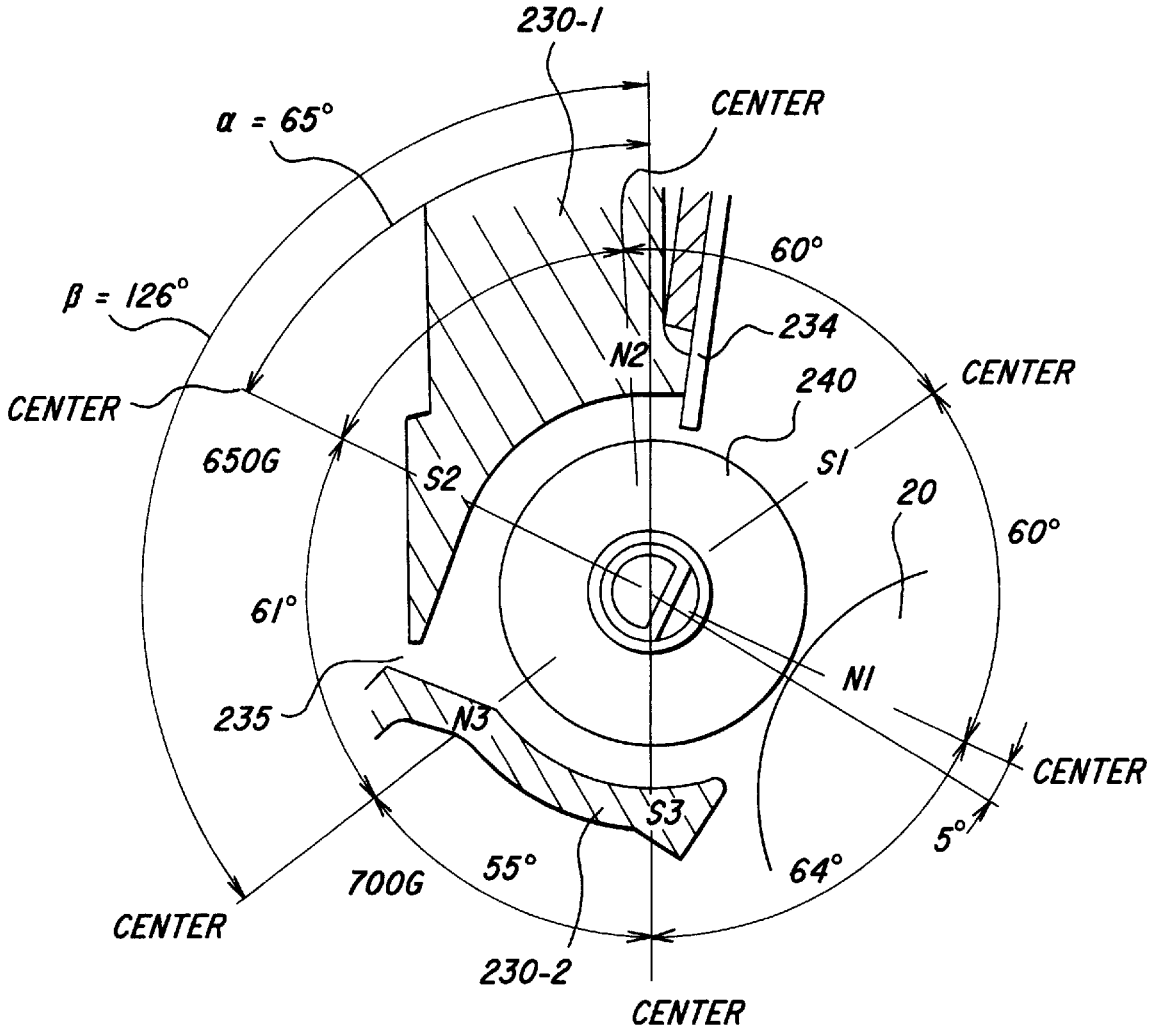
FIG. 11 is a view showing a geometry of magnetic poles of the developing unit of FIG. 5.
Figure 12:
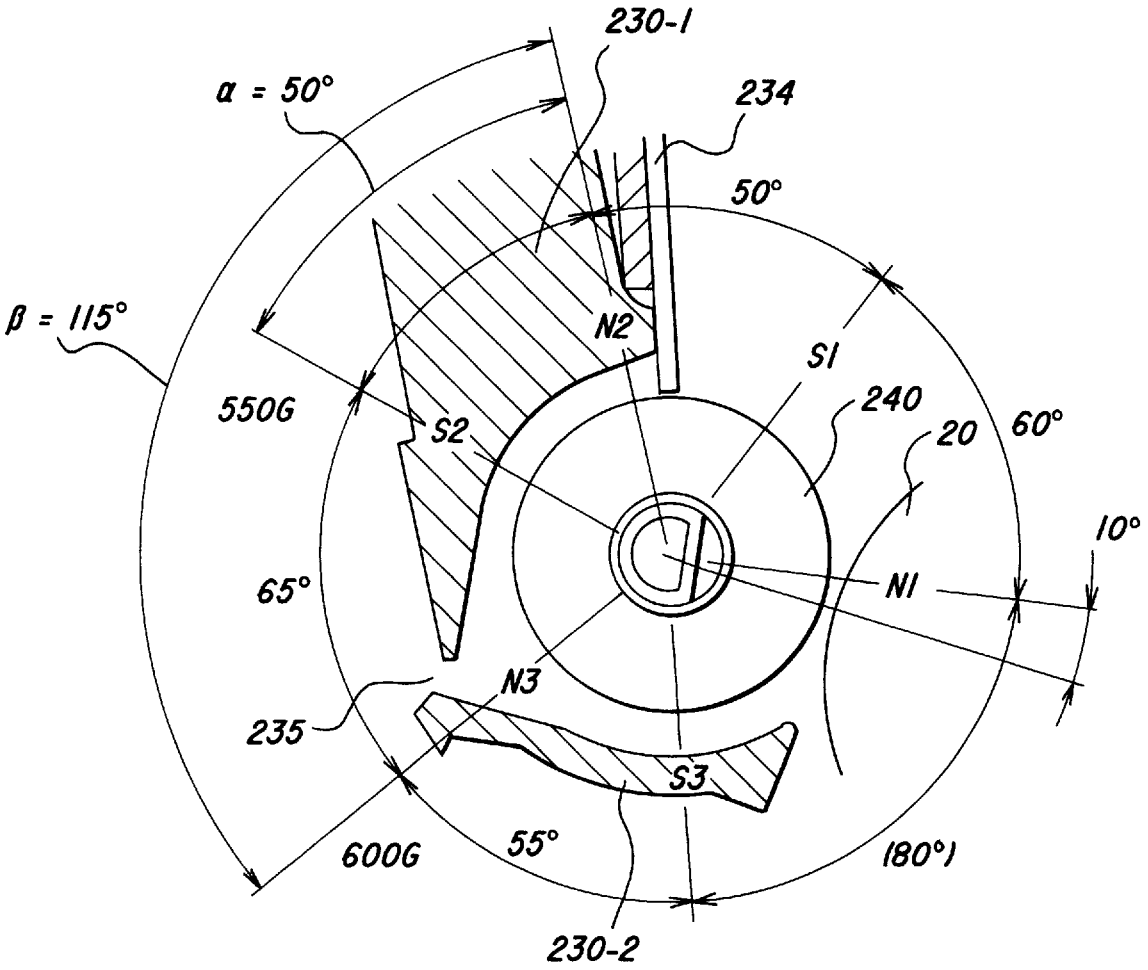
FIG. 12 is an explanatory view showing a comparative example of the geometry of the magnetic poles of FIG. 11.
Figure 13:
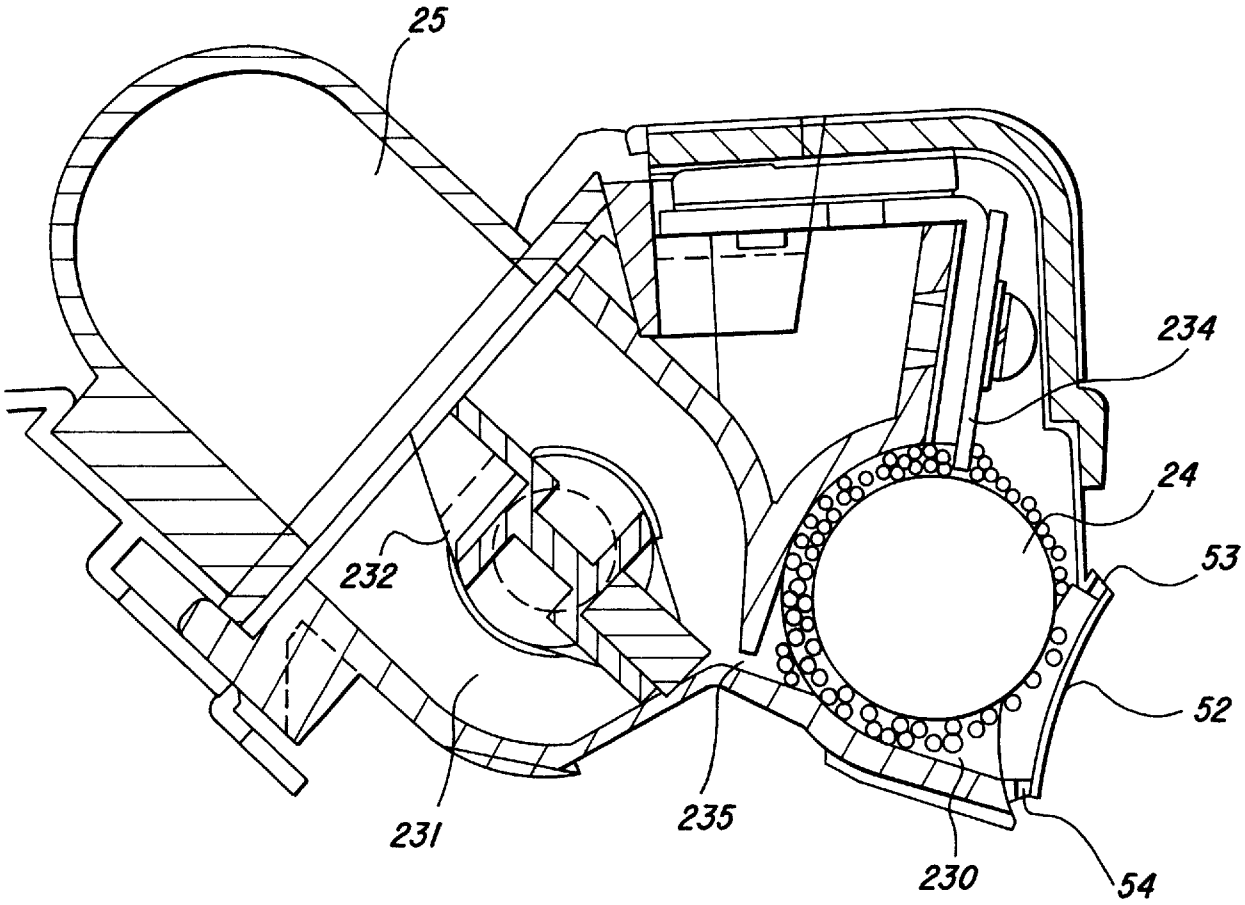
FIG. 13 is a view illustrating a configuration of a seal mechanism of the developing unit of FIG. 5.

FIG. 10 is a front view illustrating the developing unit of FIG. 5. FIG. 11 is a view showing a geometry of the magnetic poles according to the present invention. FIG. 12 is an explanatory view showing a comparative example of the geometry of the magnetic poles according to this invention. FIG. 13 is a sectional view showing a seal mechanism of the developing unit. FIG. 14 is an explanatory view of the seal mechanism.

As illustrated in FIG. 10, the developing roller 24 and the partition member 230-1 are provided between side frames 50, 51 of the developing unit 23. The wall surface 230-4 of this partition member 230-1 has such an oblique surface 230-5 as to narrow the gap in positions at both ends of the developing roller 24 in the axial direction. Each oblique surface 230-5 is 50 mm long.

More specifically, the wall surface 230-4 of the partition member 230-1 is set at a fixed spacing from the developing roller at the central portion in the axial direction of the developing roller 24. Then, the arrangement at the end portions is that the spacing from the developing roller 24 is widened toward the center from the end.

With this arrangement, the developer between the developing roller 24 and the partition member 230-1 receives a force acting toward the center from the end of the developing roller 24. The developer is thereby moved in the axial direction. It is therefore possible to prevent an ununiformity of the density in the axial direction.

Next, a placement of the magnetic pole members 240 in the sleeve 241 will be explained.

As illustrated in FIG. 11, a magnetic pole N2 is provided in an angular position shifted counterclockwise through 12 degrees from a position of the restricting blade 234. Further, a magnetic pole S2 is provided in an angular position shifted counterclockwise through 72 degrees from the position of the restricting blade 234. A magnetic pole N3 is provided in an angular position shifted likewise through 136 degrees from the position of the restricting blade 234. An angle mutually made by these six magnetic poles S1–S3 and N1–N3 is approximately 60 degrees.

When done in this manner, the position of the magnetic pole N3 is shifted from the position of the above toner supply passage 235. In general, the height of the magnetic brush in the central position of the magnetic pole comes to the maximum. Hence, the position of the magnetic pole N3 is shifted, thereby making it possible to prevent an extension of the magnetic brush from the toner supply passage 235. Consequently, a leakage of the magnetic carriers from the toner supply passage 235 can be prevented. Hence, the fluctuations in the toner density control value can be also prevented.

Further, the magnetic force of this magnetic pole S2 is set to 650 Gauss or greater; and the magnetic force of the magnetic pole N3 is set to 700 Gauss or above, i.e., thus set larger than in the prior art. With this setting, the restricting force of the magnetic brush is enhanced, and, besides, the feeding power along the developing roller 24 is also increased. For this reason, it is feasible to prevent the leakage of the magnetic carriers from the toner supply passage 235 all the more.

FIG. 12 shows a comparative example. The magnetic pole N2 is provided in an angular position shifted counterclockwise through 7 degrees from the position of the restricting blade 234. Further, the magnetic pole S2 is provided in an angular position shifted counterclockwise through 57 degrees from the position of the restricting blade 234. The magnetic pole N3 is provided in an angular position shifted likewise through 112 degrees from the position of the restricting blade 234.

In this example, the magnetic force of the magnetic pole N2 is set to 550 Gauss, while the magnetic force of the magnetic pole N3 is set to 600 Gauss. The magnetic pole N3 is located substantially in the position of the toner supply passage 235, and therefore the ununiformity of the toner density appears when continuously printing the 50 sheets. For examining a cause for this, the interior of the developing unit 23 is checked by cleaning off the developer. It can be consequently confirmed that the leakage of the carriers is seen in the vicinity the toner supply passage 235 corresponding to the position of the developing roller 24 where the ununiformity of the toner density is produced.

In this manner, the position of the magnetic pole N3 is shifted from the toner supply passage. It can be thereby confirmed that the leakage of the carriers is prevented.

Next, the seal mechanism will be explained.

As illustrated in FIG. 13, only a predetermined amount of the magnetic carriers are adhered to the peripheral portion of the developing roller 24. Then, its opening is covered with a seal 52. A pair of guides 53, 54 are provided at the upper and lower portions of the opening of the developing unit 23. This seal 52 is held by the pair of guides 53, 54 and pulled on this side in the Figure.

Figure 14A:
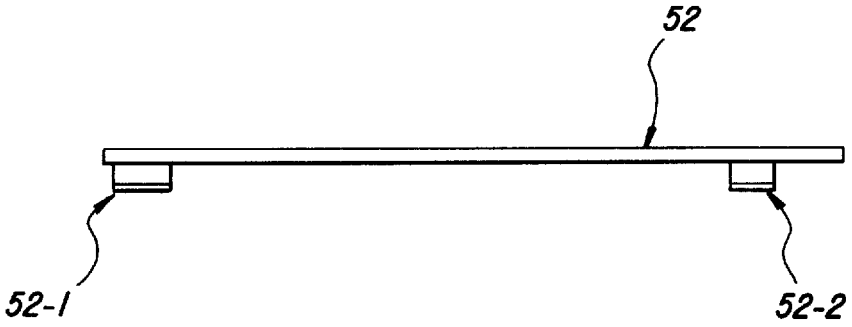
FIGS. 14 and 14B are explanatory views of the seal mechanism of FIG. 13.

As shown in FIG. 14A, sticking members 52-1, 52-2 including double-coated tapes stuck onto sponges are provided on both sides of the seal 52 such as Mylar (TM), having the generic name polyethylene telephthalate, a film, etc. Accordingly, the seal 52 is stuck to the opening of the developing unit 23 in front and rear positions in the depthwise direction of FIG. 13. On the other hand, the seal 52 is held by the guides 53, 54 in the up-and-down directions of FIG. 13 and therefore tightly closes the opening.

In this way, the apparatus is set and packaged. With this processing, no developer exists in the developing chamber 230, and there is no possibility where the toners fall out. Further, the carriers are strongly retained by the magnetic force of the developing roller 24 but are not scattered so far as a remarkable impact is exerted thereon. The opening of the developing unit 23 which is provided in a face-to-face relationship with the photosensitive drum 20 is the widest one and therefore covered with the seal 52.

The remaining opening surface of the toner supply passage 235 is small. Besides, the carrier chain is not active in terms of designing the magnetic forces but is located away from the toner supply passage 235. For this reason, even if the carriers are scattered, a probability of entering the toner supply chamber 231 via the supply passage 235 is extremely small. Further, even if a trace amount of carriers enter the chamber 231, the carriers do not exit the developing unit 23. In addition, the influence on the toner density controllability is extremely small, and hence there is not necessity for the seal of the supply passage 235.

In the 1.5-component development, the drum gap is typically narrow (0.3 mm–0.4 mm). When the seal structure is strictly configured, the seal contacts the photosensitive drum 20. It is therefore difficult to transport the apparatus in a state where the developing unit is mounted in the apparatus. In this example where only the carriers are charged therein, however, the seal 52 is set to 0.2 mm or under in consideration of the drum gap. Further, as illustrated in FIG. 14B, when pulling out the seal 52, the guides 53, 54 are provided at the opening of the developing unit 23 so as not to contact the photosensitive drum 20.

Figure 14B:
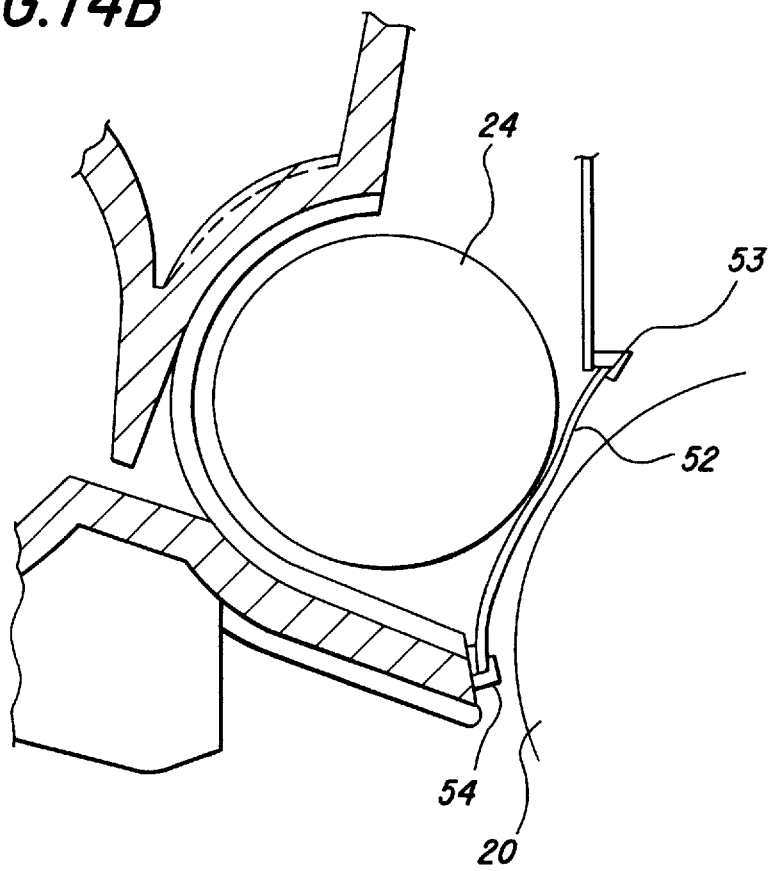

Accordingly, as shown in FIG. 14B, no damage is given to the photosensitive drum 20 even when transporting the apparatus mounted with the developing unit 23. Further, the apparatus can be packaged with a simple seal. Moreover, after being packaged, the user pulls out the seal 52 and sets the toner cartridge 25, thus coming to a get-ready-for-printing state.

Figure 15:
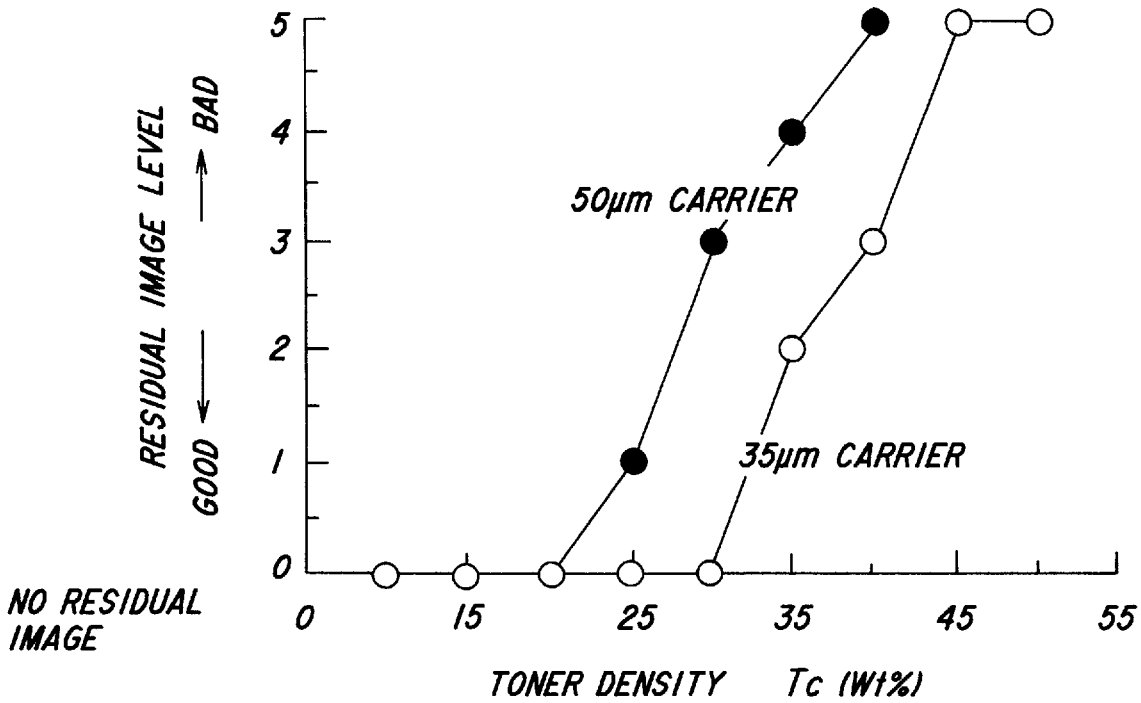
FIG. 15 is a diagram showing a relationship of a residual image versus a toner density in the developing chamber of FIG. 5.
Figure 16:
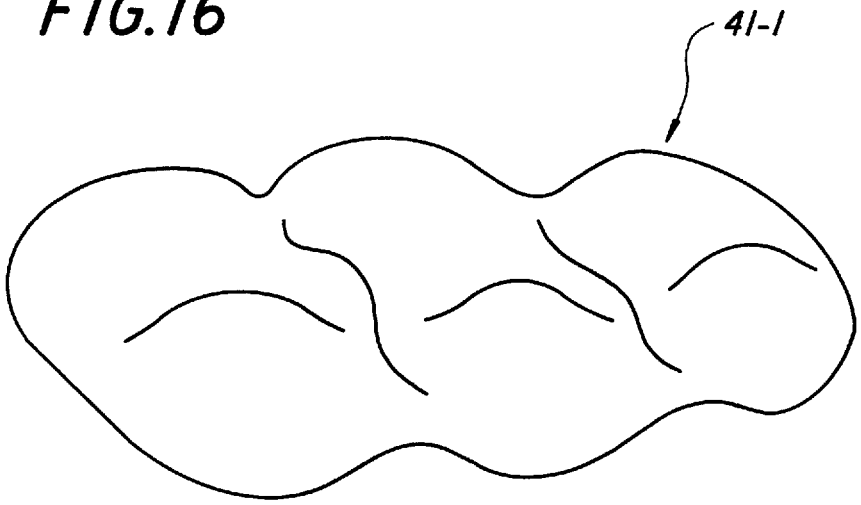
FIG. 16 is an explanatory view showing a carrier in the developing unit of FIG. 5.
Figure 17:
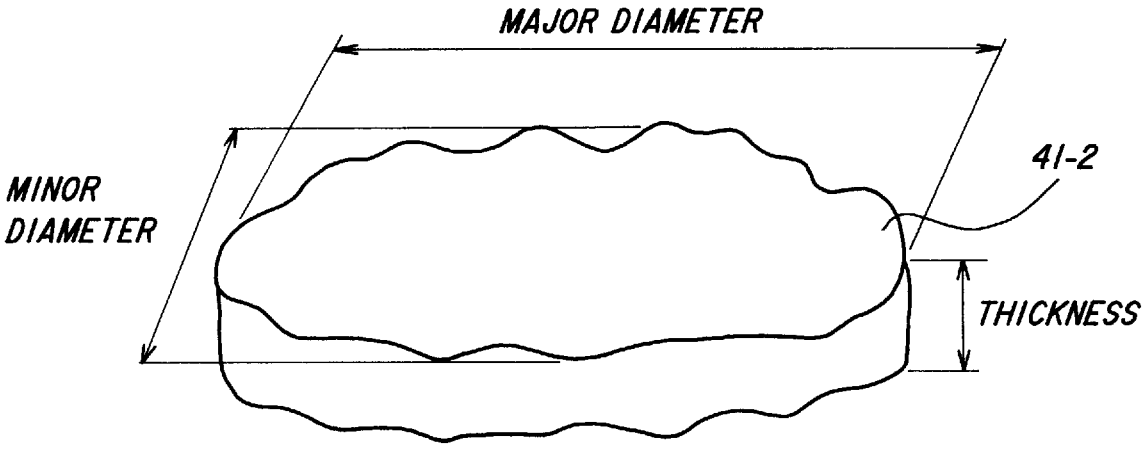
FIG. 17 is an explanatory view showing another carrier in the developing unit of FIG. 5.
Figure 18A:
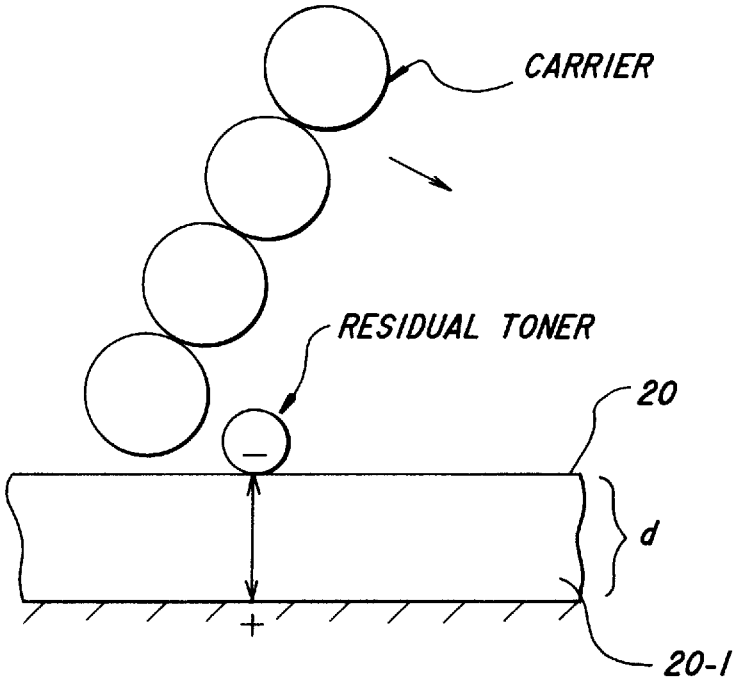
FIGS. 18A and 18B are views of assistance in explaining how the developing unit of FIG. 5 collects the residual toners.
Figure 18B:
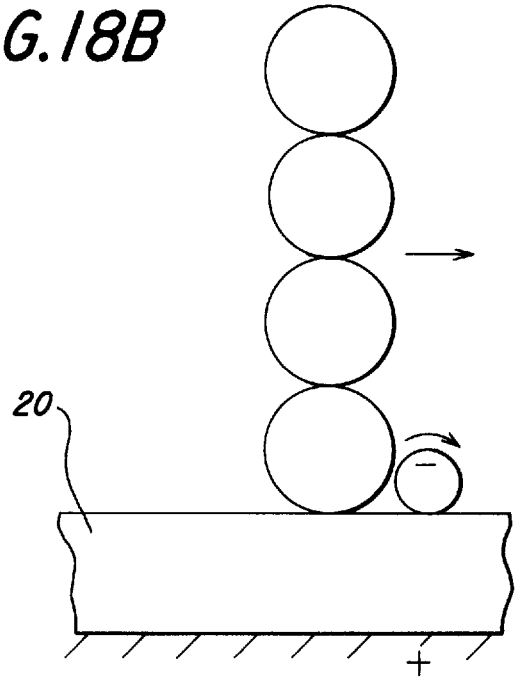
Figure 19:
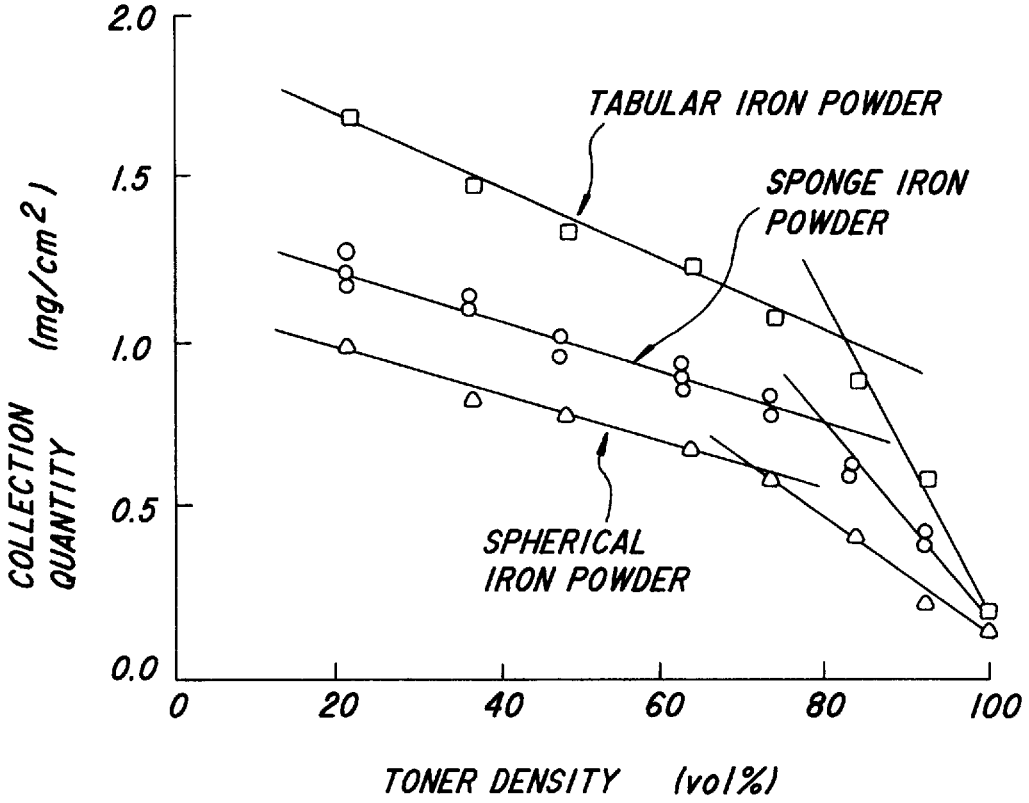
FIG. 19 is a characteristic diagram showing a quantity of the collected carriers of FIG. 16.

FIG. 15 is a diagram of a relationship of the toner density versus the residual image according to this invention. FIGS. 16 and 17 are views each illustrating a configuration of the carrier according to this invention. FIGS. 18A and 18B are views of assistance in explaining the operation of collecting the residual toners according to this invention. FIG. 19 is a characteristic diagram showing an amount of collection of the carriers of FIG. 17

In the cleanerless process, for enhancing the collecting power by the magnetic brush of the developing unit 23, the toner density that is a limit toner density or under has to be actualized on the developing roller 24. If not more than the limit toner density, the magnetic brush has an allowance for adhering the toners. Therefore, the residual toners on the photosensitive drum 20 can be sufficiently collected.

In the cleanerless process, the control of the toner density is determined by a quantity of the carriers with respect to a capacity of the developer accommodating chamber (developing chamber). A lower limit value with which the stable control is attained is 20 wt %–25 wt %.

When this toner density is set to the limit toner density, a carrier particle size with which the collecting power can be expected is 35 μm. To be specific, as illustrated in FIG. 15, when comparing the carrier having a particle size of 50 μm with a carrier having a particle size of 35 μm, the maximum toner density with no residual image is larger in the 35 μm carrier than in the 50 μm carrier. Hence, a more favorable result is obtained by using the 35 μm carrier than by using the 50 μm carrier.

A problem arising when the central particle size is set to 35 μm is that the carriers having small particle sizes are attracted by the photosensitive drum 20. In the normal two-component system, even when the carriers having the carrier particle size of this degree are adhered to the photosensitive drum 20, there is no problem in terms of the image. In the 1.5-component process, however, the toner density value is controlled in accordance with the quantity of the carriers with respect to the capacity of the developer accommodating chamber (developing chamber). Therefore, the attraction of the carriers leads to fluctuations in the toner density control value (an increase in the toner density). For this reason, the density exceeds the limit toner density enough to induce image defects such as a residual image, a fog, etc.

Under such circumstances, a core material of even the 35 μm carrier involves the use of iron powder so that the carriers are not attracted by the photosensitive drum 20. A saturation magnetization of the iron powder is approximately 200 emu/g as strong as normal magnet/ferrite. Therefore, the carriers are held on the sleeve 241 by the magnetic force of the magnet 240 in the sleeve 24, thus preventing the attraction of the carriers.

Next, as illustrated in FIG. 18A, the residual toners are attracted by the magnetic force and the electrostatic force while the carrier chain rotates the residual toners on the photosensitive drum 20, thus collecting the residual toners. Accordingly, an increases in the surface area of the carrier is effective in expecting the much stronger collecting power.

For this purpose, as shown in FIG. 16, the carrier configuration is varied from the one resembling to a spherical shape to a twisted shape (sponge shape) 41-1. With this configuration, a substantial quantity of the toner adhesion enhances even with the same carrier particle size, thereby obtaining the high collecting power. Further, as illustrated in FIG. 17, it is more preferable that the carrier assumes a tabular shape 41-2.

As described above, the magnetic carrier uses the carrier taking the twisted shape, resulting in an increase in the surface area of the carrier. This enables the enhancement in the collecting power of the residual toners in the cleanerless process. Moreover, the tabular carrier is employed as a magnetic carrier, and the surface area of the carrier is therefore increased all the more. This further enhances the collecting power of the residual toners in the cleanerless process.

FIG. 19 is a characteristic diagram showing a comparison of the carrier collecting quantity. As obvious from this Figure, the collection quantity is larger in the twisted sponge iron powder carrier 41-1 than in the spherical iron powder carrier. Further, the collection quantity is larger in the tabular iron carrier 41-2 than in the carrier 41-1.

Note that the iron powder carrier having the high magnetic force is slightly small in terms of the toner electrification controllability. It is therefore preferable to use a mixture with other carriers exhibiting an excellent toner electrification controllability in order to improve the toner electrification controllability.

Further, a layer thickness of a photoconductive layer 20-1 shown in FIG. 18A is preferably 10 μm–30 μm. That is, the residual toners after being transferred are adhered to the surface of the photosensitive drum by the electrostatic force. This force is defined as a force by which the electric charge that the toners bear and the electric charge (having the same magnitude of the toner electric charge but an opposite polarity thereto) induced in a photosensitive body conductive layer by the toner electric charge are attracted each other.

Accordingly, this force becomes larger with a smaller thickness of the photosensitive layer. The collection by the developing unit is therefore difficult. For this reason, the residual image is easily formed. Especially when the layer thickness is 10 μm or under, the formation of the residual image easily takes place. Additionally, if over 30 μm, the image density is decreased. The layer thickness of the photoconductive layer 20-1 is therefore preferably 10 μm–30 μm.

Further, when the sleeve 241 is rotated at a velocity twice as high as the peripheral speed of the photosensitive drum 20, the toners are collected well. That is, the developer rubs on the residual toners on the photosensitive drum 20 by increasing the moving velocity of the developer in the developing unit with respect to the photosensitive drum. As a result, the toners move on the photosensitive drum while rolling thereon, and the electrostatic force by which the toners are adhered to the photosensitive body decreases. The toners are thus collected with a facility. This happens due to the fact that the electric charges possessed by the toners are unevenly distributed. As described above, when the sleeve 241 is rotated at a velocity not less than twice the peripheral speed of the photosensitive drum 20, the toners are well collected.

Figure 20B:
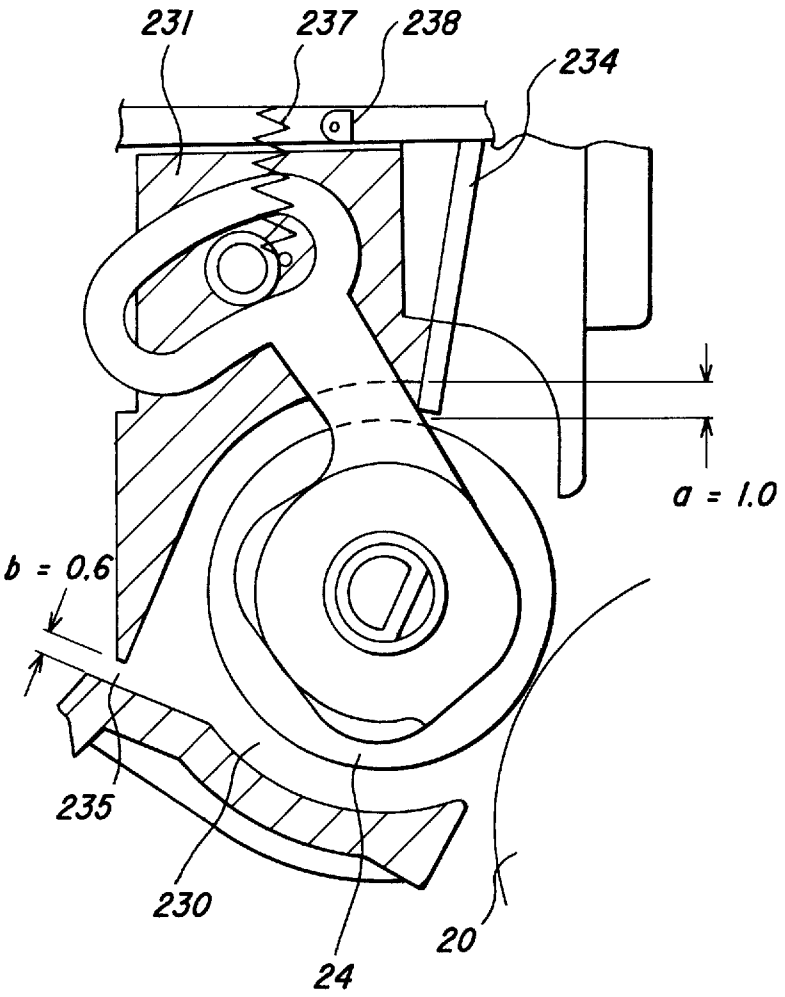
FIGS. 20A and 20B are explanatory views each showing a jam recovery action of the developing unit of FIG. 5.
Figure 20A:
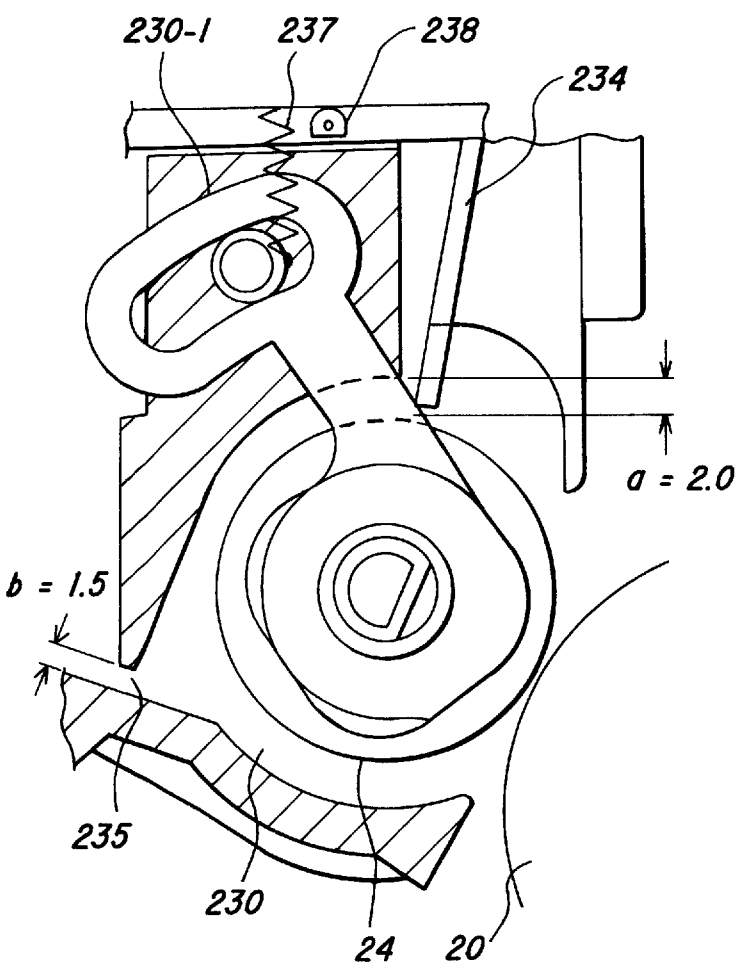
Figure 21:
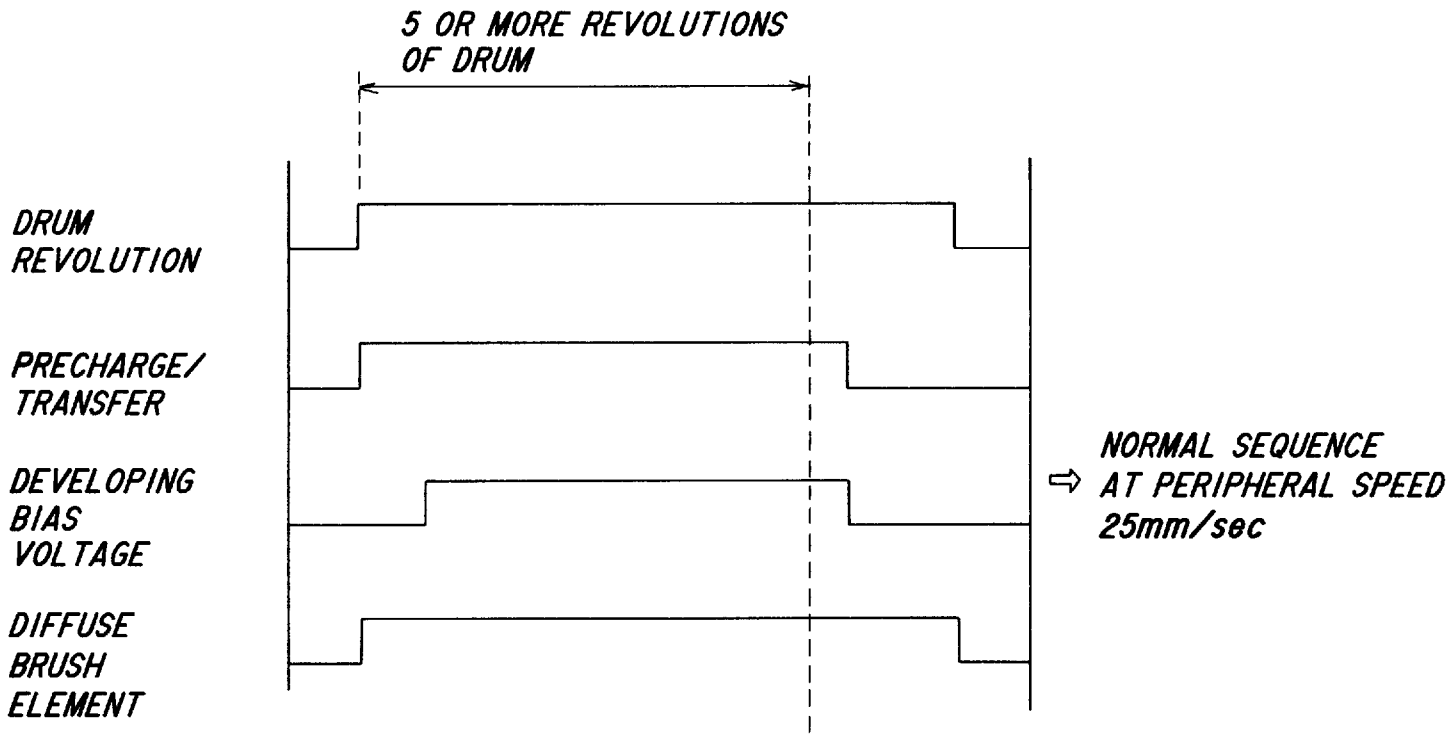
FIG. 21 is an explanatory view showing a jam recovery sequence of FIGS. 20A and 20B.

FIGS. 20A and 20B are views of assistance in explaining a jam recovery action in one embodiment of this invention. FIG. 21 is an explanatory view showing a jam recovery sequence of FIGS. 20A and 20B.

As illustrated in FIG. 20A, a spring 237 and a cam 238 are interposed between the partition member 230-1 and the developing unit frame. A normal printing state is shown in FIG. 20A. A gap between the developing roller 24 and the partition member 230-1 is 2 mm.

On the other hand, when in the recovery action after the jam is caused, as illustrated in FIG. 20B, the cam 238 is operated. Then, the partition member 230-1 separate from the blade 234 is lowered down while resisting a restoring force of the spring 237. The gap between the developing chamber 231 and the partition member 230-1 is thereby decreased down to 1 mm, resulting in a reduction in the capacity of the developing chamber 231. Concurrently with this process, a gap b of the toner supply passage is reduced from 1.5 mm down to 0.6 mm.

The following is a reason why the above arrangement is done. When the jam happens, the apparatus stops in the middle of the printing process, and consequently the image before being transferred is left on the photosensitive drum as it is. Therefore, the residual toners can not be collected unless the developing unit is rotated for a considerable period of time. Further, in this collection process, a large amount of residual toners pass through the diffuse brush 28, with the result that the load on the brush augments. Concurrently with this, a great quantity of toners are mixed in between the brush bristles, which leads a possibility of decreasing a life-span thereof.

In the cleanerless process, there is nothing but the developing unit 23 absorbing a large amount of residual toners. A method of enhancing the collection by the developing unit 23 most effectively involves reducing the toner density and increasing the quantity of toners adhered to the magnetic brush.

Hence, as depicted in FIG. 20B, the partition member 230-1 is lowered only when in the jam recovery sequence, thereby reducing the capacity of the developing chamber 231. With this processing, the quantity of the carriers existing in the developing chamber 231 does not change, and hence the toner control value is decreased. At the same time, the toner supply passage 235 is also narrowed, resulting in a lack of the toner supply quantity.

Consequently, the power by which the magnetic brush collects the residual toners increases. Normally, when set in this state, the ununiformity of the toner density is seen at a stage of printing several tens of sheets. However, the time is short only when in the jam recovery, and there is no problem. Further, the toner supply passage 235 is narrowed, and the carriers do not leak out because of an extension of the magnetic brush.

Moreover, the number revolutions of the sleeve 241 of the developing roller 24 is increased up to 150 mm/sec from a normal number of revolutions of 75 mm/sec. The collection quantity per unit time can be thereby obtained, and, therefore, this method is also effected in enhancing the collecting power.

Next, as illustrated in FIG. 21, five or more revolutions of the photosensitive drum 20 is desirable in this jam recovery sequence. In this case, the number of revolutions of the photosensitive drum 20 is set to 75 mm/sec that is three times the normal number of revolutions, and a recovery time can be thereby reduced. Then, when starting the print after finishing the recovery, the photosensitive drum is returned to the normal number of revolutions of 25 mm/sec.

Further, a large amount of toners pass through the diffuse brush 28 when in the recovery sequence. At this moment, the toners are mixed in between the bristles of the diffuse brush 28. Besides, with an increase in the number of revolutions, the toners emit heat, and it can be considered that filming occurs. For this reason, a preferable arrangement when in the jam recovery is that the diffuse brush 28 is moved back so as not to contact the photosensitive drum 20.

Note that the cam 238 is rotated and reverts to a state shown in FIG. 20A after an end of the jam recovery sequence.

When taking such an action, the jam recovery time may be one-half the normal time.

Figure 22A:
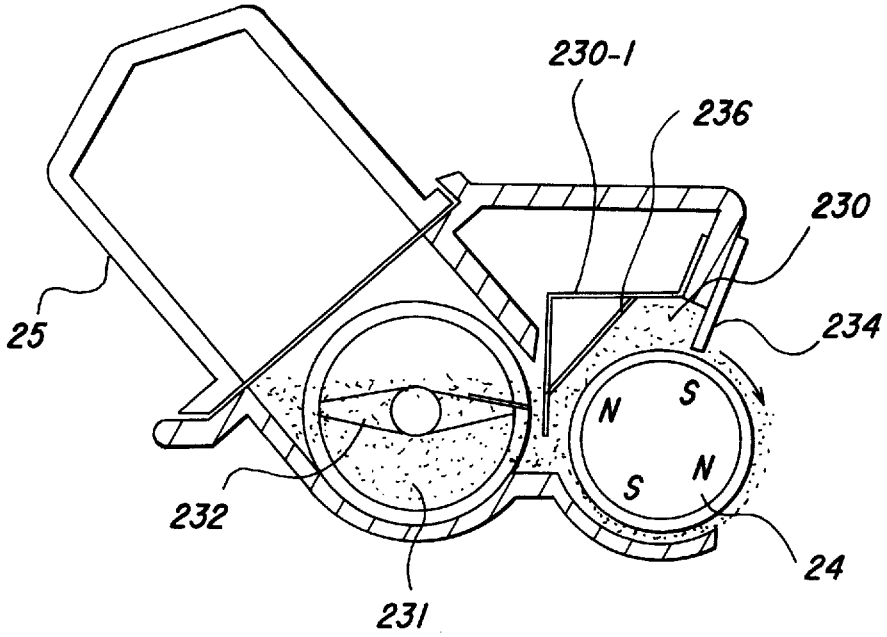
FIGS. 22A and 22B are views each showing an example of a variant form of the developing unit of this invention.
Figure 22B:
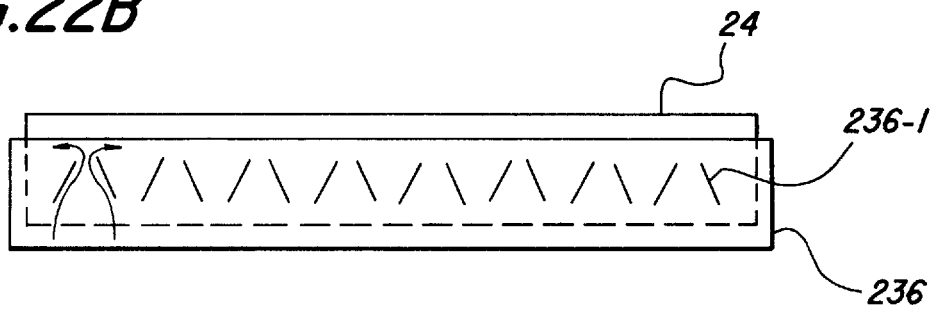
Figure 23:
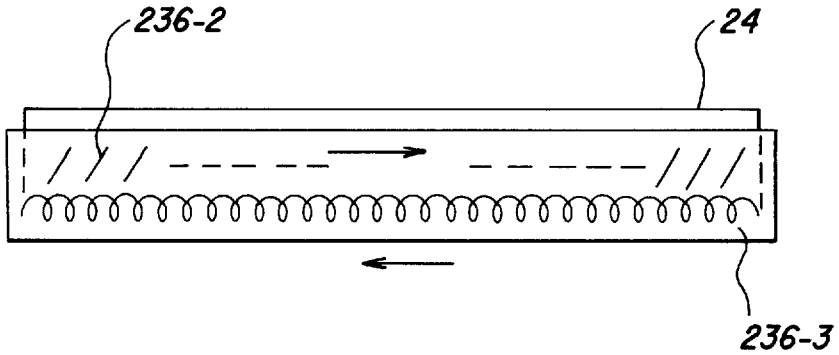
FIG. 23 is a block diagram showing another example of the variant form of the present invention.

FIGS. 22A and 22B are views showing an example of a variant form of the present invention. FIG. 23 is a block diagram showing another example of the variant form of this invention.

As illustrated in FIG. 22A, the angulate partition member 230-1 is provided obliquely with a rectifier plate 236. With this arrangement, the developing chamber assumes a configuration resembling a shape of the developing roller, and there is obtained the same effect as taking the configuration shown in FIG. 5.

Further, as illustrated in FIG. 22B, this rectifier plate 236 is mounted obliquely with a guide 236-1. The developer is thereby movable in the axial direction of the developing roller 24. Accordingly, the same effect as providing the guide shown in FIG. 10 is exhibited.

Moreover, FIG. 23 shows an example of a modification of the rectifier plate 236, wherein the rectifier 236 is fitted with a rotary spiral member (spring) 236-3. With this arrangement, the developer is movable in the axial direction of the developing roller 24. Hence, the same effect as providing the guide shown in FIG. 10 is exhibited. At this time, if the rectifier plate 236 is provided obliquely with a guide 236-2, a stirring capability in the axial direction can be enhanced.

Further, still another example of modification will be given. The wall surface 230-4 of the partition member 230-1 explained in FIG. 5 is coated with the same material as the carrier coating material. The toners are thereby electrified by even a friction against the wall surface 230-4. It is therefore possible to restrain a generation of the low-electrified toners. As a result, the toners are not scattered, whereby contaminations can be prevented from being produced.

Figure 24A:
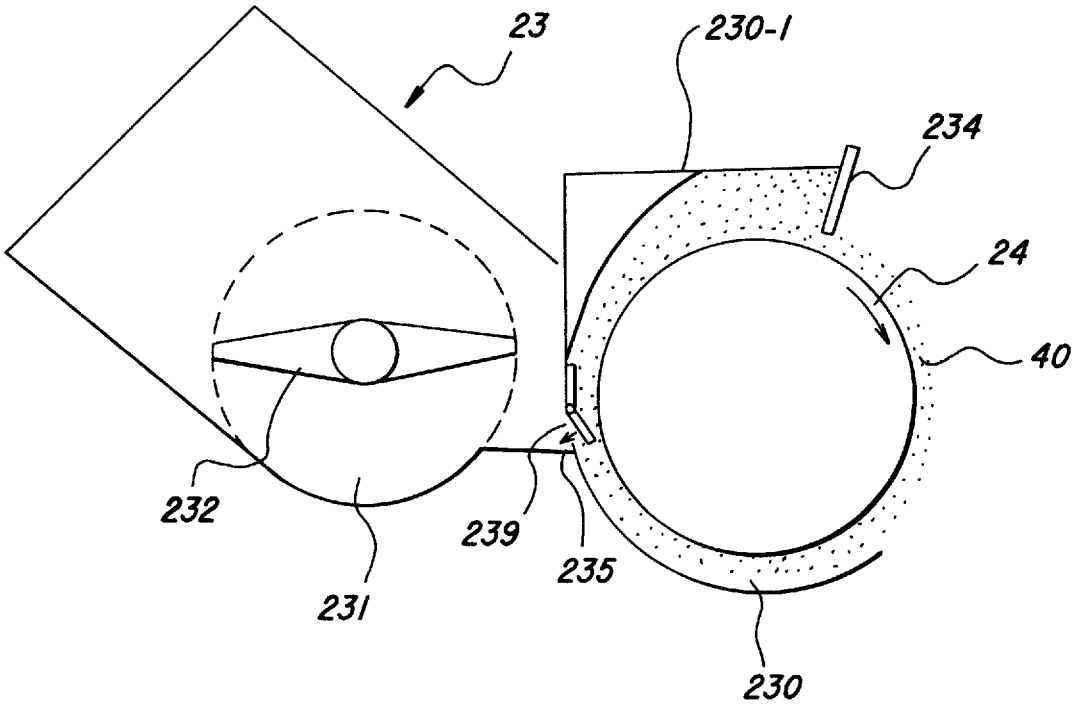
FIGS. 24A and 24B are block diagrams each showing still another example of the variant form of the present invention.
Figure 24B:
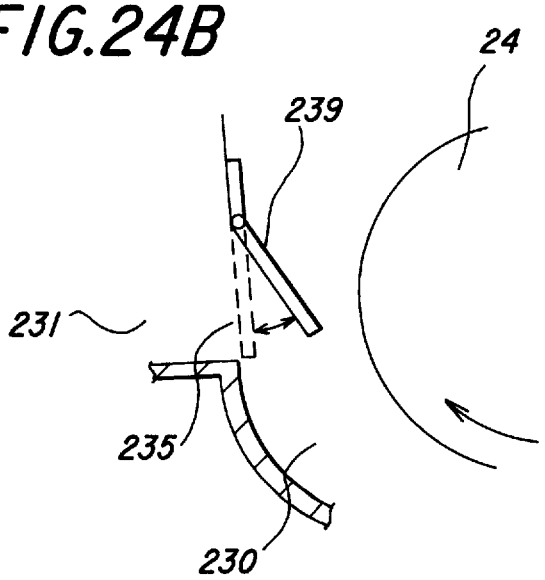
Figure 25A:
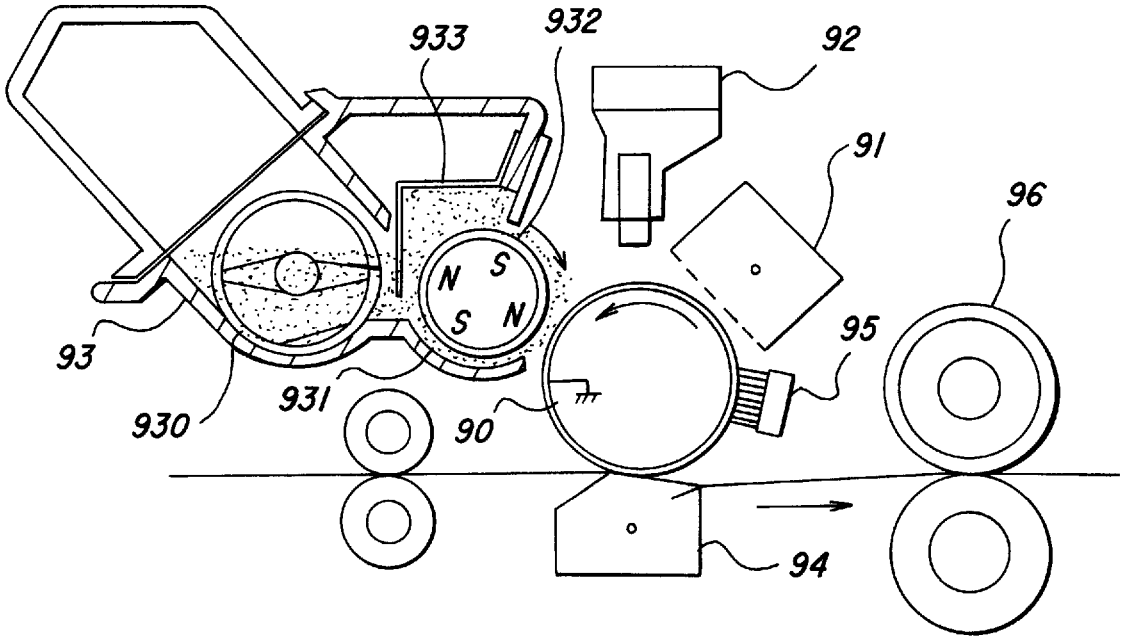
FIG.25A PRIOR ART
FIGS. 25A and 25B are explanatory views of the prior art.
Figure 25B:
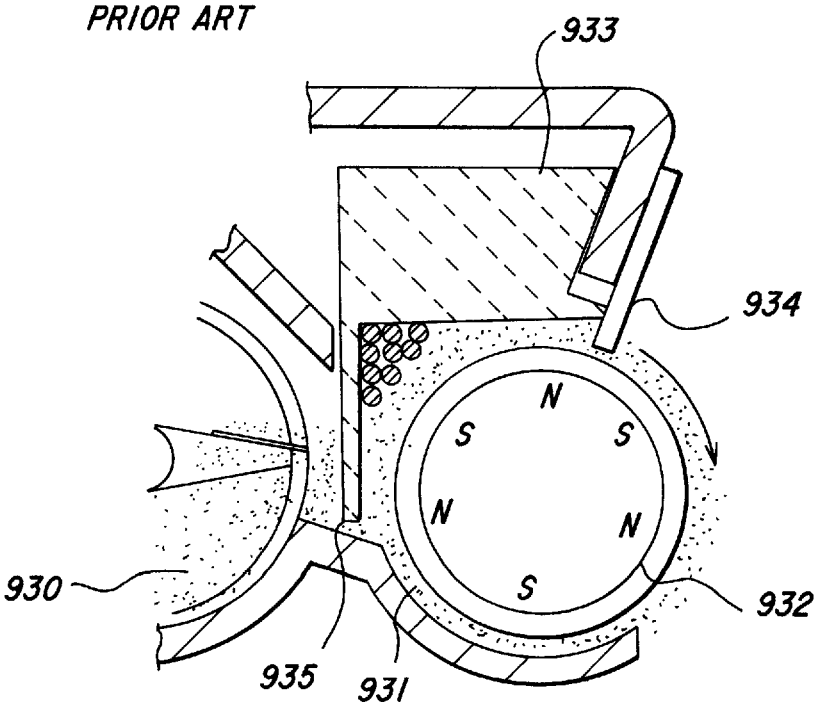
FIG.25B PRIOR ART

FIGS. 24A and 24B shows an example of a modification of a carrier leakage preventive mechanism explained in FIGS. 5 and 11. As illustrated in FIGS. 24A and 24B, the toner supply passage 235 is provided with a contraflow preventive valve 239. This contraflow preventive valve 239 permits an inflow of the toners into the developing chamber 230 from the toner supply passage 231 but prevents an inflow of the carriers of the developing chamber 230 into the toner supply chamber 231. With this action, no jam is produced in the toner supply passage 235, thereby enabling the stable toner supply.

The following modifications other than the embodiments discussed above can be given according to this invention.

Firstly, the image exposing unit involves the use of the LED optical system but may employ a laser optical system, a liquid crystal shutter optical system, an EL (electroluminescence) optical system, etc.. Secondly, the latent image forming mechanism has been explained as an electrophotographic mechanism in the embodiments discussed above but is usable as a latent forming mechanism (e.g., an electrostatic recording mechanism or the like) for transferring the toner image. The sheet is not confined to a chart but may use other mediums. Moreover, the photosensitive drum is not limited to the drum-like configuration but may take a belt-like configuration. Thirdly, the image forming apparatus has been explained as a printer but may take other forms such as a copying machine, a facsimile, etc.

The present invention has been discussed by way of the embodiments but may be embodied in a variety of modifications within a range of the gist of the present invention. Those modifications are not eliminated from the appended claims of the present invention.

As described above, according to the present invention, the carriers in the developing chamber works effectively in the 1.5-component developing method. The fluctuations in the toner density control value can be therefore prevented. The image with a high and stable quality is thereby obtainable.

What is claimed is:

1. A developing apparatus for developing an electrostatic latent image on a latent image carrier by supplying said latent image carrier with a developer, said apparatus comprising:

a toner accommodating chamber for accommodating magnetic toners;

a developing roller having a plurality of fixed magnetic pole members and at least one sleeve provided along peripheries of said fixed magnetic pole members and rotating thereabout for feeding the developer composed of magnetic carriers and magnetic toners to said latent image carrier; a developing chamber having a partition wall formed along said developing roller and assuming a configuration adapted to a shape of said developing roller;

a toner supply port for supplying the magnetic toners to said developing chamber from said toner accommodating chamber, wherein a center of a magnetic pole member, which is disposed at a nearest location to the toner supply port, is located in a position deviating from said toner supply port; and wherein a doctor blade is provided in the developing chamber, wherein said partition wall has a first part which extends from the doctor blade and assumes said configuration adapted to said shape of said developing rollers and a second part which extends from said first part to the toner supply port, and wherein said second part, in extending to said toner supply port, deviates progressively from said sleeve for accepting the developer that is fed on the sleeve.

2. The developing apparatus according to claim 1, wherein the magnetic carriers each have a core composed of iron powder exhibiting saturation magnetization.

3. The developing apparatus according to claim 1, wherein said developing roller feeds the developer to said latent image carrier and, at the same time, collects residual toners on said latent image carrier, and wherein the magnetic carriers are particles which each assume a twisted configuration.

4. The developing apparatus according to claim 1, wherein said developing roller feeds the developer to said latent image carrier and, at the same time, collects residual toners on said latent image carrier, and wherein the magnetic carriers are particles which each assume a tabular configuration.

5. A developing apparatus for developing an electrostatic latent image on a latent image carrier by supplying said latent image carrier with a developer, said apparatus comprising:

a toner accommodating chamber for accommodating magnetic toners;

a developing roller having a plurality of fixed magnetic pole members and at least one sleeve provided along peripheries of said fixed magnetic pole members and rotating thereabout for feeding the developer composed of magnetic carriers and magnetic toners to said latent image carrier; a developing chamber having a partition wall formed along said developing roller and assuming a configuration adapted to a shape of said developing roller;

a toner supply port for supplying the magnetic toners to said developing chamber from said toner accommodating chamber, wherein a center of a magnetic pole member, which is disposed at a nearest location to the toner supply port, is located in a position deviating from said toner supply port;

wherein a doctor blade is provided in the developing chamber, wherein said partition wall has a first part which extends from the doctor blade and assumes said configuration adapted to said shape of said developing roller and a second part which extends from said first part to the toner supply port and wherein said second part extends to said toner supply port while deviating progressively from said sleeve of said developing roller so as to be apart from said sleeve by the imposition of a gap between said partition wall and said developing roller in a peripheral portion of said toner supply port set larger than a gap between said partition wall and said developing roller in a portion other than the peripheral portion of said toner supply port for accepting the developer that is fed on the sleeve.

6. The developing apparatus according to claim 5, further comprising a guide member, provided on said partition wall, for guiding movement of the developer in an axial direction of said developing roller.

7. The developing apparatus according to claim 5, wherein the magnetic carriers are composed of particles each having a core which is iron powder exhibiting saturation magnetization.

8. The developing apparatus according to claim 5, wherein said developing roller feeds the developer to said latent image carrier and, at the same time, collects residual toners on said latent image carrier, and wherein the magnetic carriers are composed of particles which each assumes a twisted configuration.

9. The developing apparatus according to claim 5, wherein said developing roller feeds the developer to said latent image carrier and, at the same time, collects residual toners on said latent image carrier, and wherein the magnetic carriers are composed of particles which each assumes a tabular configuration.

10. A developing apparatus for developing an electrostatic latent image on a latent image carrier by supplying said latent image carrier with a developer, said apparatus comprising:

a toner accommodating chamber for accommodating magnetic toners;

a developing roller having a plurality of fixed magnetic pole members and at least one sleeve provided along peripheries of said fixed magnetic pole members and rotating thereabout for feeding the developer composed of magnetic carriers and magnetic toners to said latent image carrier; a developing chamber having a partition wall formed alone said developing roller and assuming a configuration adapted to a shape of said developing roller;

a toner supply port for supplying the magnetic toners to said developing chamber from said toner accommodating chamber, wherein a center of a magnetic pole member, which is disposed at a nearest location to the toner supply port, is located in a position deviating from said toner supply port; and wherein a doctor blade is provided in the developing chamber, wherein said partition wall has a first part which extends from the doctor blade and assumes said configuration adapted to said shape of said developing roller and a second part which extends from said first part to the toner supply port, wherein said second part extends to said toner supply port so as to be apart from said sleeve for accepting the developer that is fed on the sleeve; and further comprising a guide member, provided on said partition wall, for guiding a movement of the developer in an axial direction of said developing roller.

11. The developing apparatus according to claim 10, wherein the magnetic carriers are composed of particles which each includes a core which is iron powder exhibiting saturation magnetization.

12. The developing apparatus according to claim 10, wherein said developing roller feeds the developer to said latent image carrier and, at the same time, collects residual toners on said latent image carrier, and wherein the magnetic carriers are composed of particles which each assumes a twisted configuration.

13. The developing apparatus according to claim 10, wherein said developing roller feeds the developer to said latent image carrier and, at the same time, collects residual toners on said latent image carrier, and wherein the magnetic carriers are composed of particles which each assumes a tabular configuration.

14. A developing apparatus for developing an electrostatic latent image carrier by supplying said latent image carrier with a developer, said apparatus comprising: a toner accommodating chamber for accommodating magnetic toners;

a developing chamber supplied with the magnetic toners via a toner supply port from said toner accommodating chamber;

a developing roller containing a rotatable sleeve for feeding the developer composed of magnetic carriers and the magnetic toners in said developing chamber to said latent image carrier; and a fixed magnetic pole member provided within said sleeve and having a plurality of magnetic poles, and a center of each magnetic pole being located in a position deviating from said toner supply port; wherein a center of a magnetic pole, which is disposed at a nearest location to the toner supply port, is located in a position deviating from said toner supply port;

wherein a doctor blade is provided in the developing chamber, wherein a partition wall has a first part which extends from the doctor blade and assumes a configuration adapted to a shape of said developing roller and a second part which extends from said first part to the toner supply port, and wherein said second part extends to said toner supply port while deviating progressively from said sleeve of said developing roller so as to be apart from said sleeve for accepting the developer that is fed on the sleeve.

15. The developing apparatus according to claim 14, wherein the magnetic carriers are composed of particles which each includes a core which is iron powder exhibiting saturation magnetization.

16. The developing apparatus according to claim 14, further comprising a developing roller constructed of said sleeve and said fixed magnetic pole member and which feeds the developer to said latent image carrier and, at the same time, collects residual toners on said latent image carrier, and wherein the magnetic carriers are composed of particles which each includes a twisted configuration.

17. The developing apparatus according to claim 14, further comprising a developing roller constructed of said sleeve and said fixed magnetic pole member which feeds the developer to said latent image carrier and, at the same time, collects residual toners on said latent image carrier, and wherein the magnetic carriers are composed of particles which each includes a tabular configuration.

18. A developing apparatus for developing an electrostatic latent image on a latent image carrier by supplying said latent image carrier with a developer, said apparatus comprising:

a toner accommodating chamber for accommodating magnetic toners;

a developing roller including at least one rotatable sleeve provided along peripheries of a plurality of fixed magnetic pole members to feed the developer composed of the magnetic toners and magnetic carriers having a core of iron powder exhibiting strong saturation magnetization to said latent image carrier, said iron powder having a level of saturation of the powder of 200 emu/g, and a plurality of magnetic poles are provided, wherein an upper one of said plurality of magnetic poles has a force of 650 Gauss and a lower one of said plurality of magnetic poles has a force of at least 700 Gauss;

a developing chamber provided with said developing roller; and a toner support port for supplying the magnetic toners to said developing chamber from said toner accommodating chamber.

19. The developing apparatus according to claim 18, wherein said developing roller feeds the developer to said latent image carrier and, at the same time, collects residual toners on said latent image carrier, and wherein the magnetic carriers are composed of particles which each includes a twisted configuration.

20. The developing apparatus according to claim 18, wherein said developing roller feeds the developer to said latent image carrier and, at the same time, collects residual toners on said latent image carrier, and wherein the magnetic carriers are composed of particles which each includes a tabular configuration.

21. A developing apparatus for developing an electrostatic latent image on a latent image carrier by supplying said latent image carrier with a developer, said apparatus comprising:

a toner accommodating chamber for accommodating magnetic toners;

a developing roller including at least one rotatable sleeve provided along peripheries of a plurality of fixed magnetic pole members to feed the developer composed of the magnetic toners and magnetic carriers having a core of iron powder exhibiting strong saturation magnetization to said latent image carrier, said magnetic carriers being comprised of an iron carrier having an elongated shape;

a developing chamber provided with said developing roller, a range of toner density in the developing chamber being 20% to 30% by weight; and a toner support port for supplying the magnetic toners to said developing chamber from said toner accommodating chamber.

22. The developing apparatus according to claim 21, wherein said developing roller feeds the developer to said latent image carrier and, at the same time, collects residual toners on said latent image carrier, and wherein the magnetic carriers are composed of particles which each includes a twisted configuration.

23. The developing apparatus according to claim 21, wherein said developing roller feeds the developer to said latent image carrier and, at the same time, collects residual toners on said latent image carrier, and wherein the magnetic carriers are composed of particles which each includes a tabular configuration.

* * * * *